US007177552B2

(12) United States Patent
Koike

(10) Patent No.: US 7,177,552 B2
(45) Date of Patent: Feb. 13, 2007

(54) IMAGE FORMING APPARATUS, IMAGING PROCESS UNIT, AND METHOD FOR RECORDING INFORMATION CONCERNING IMAGING PROCESS UNIT

(75) Inventor: Takahisa Koike, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 98 days.

(21) Appl. No.: 11/016,926

(22) Filed: Dec. 21, 2004

(65) Prior Publication Data

US 2005/0180764 A1 Aug. 18, 2005

(30) Foreign Application Priority Data

Dec. 22, 2003 (JP) ..... 2003-425686
Aug. 17, 2004 (JP) ..... 2004-237608
Nov. 25, 2004 (JP) ..... 2004-340702

(51) Int. Cl.
*G03G 15/00* (2006.01)
*G03G 21/16* (2006.01)

(52) U.S. Cl. ..... 399/12; 399/8; 399/111

(58) Field of Classification Search ..... 399/1, 399/8, 12, 13, 24, 25, 27, 110, 111, 119
See application file for complete search history.

(56) References Cited

U.S. PATENT DOCUMENTS 6,529,692 B1 3/2003 Haines et al.
6,625,402 B2 * 9/2003 Takemoto ..... 399/8
2002/0108052 A1 8/2002 Maruyama
2002/0122671 A1 9/2002 Yoshimura
2002/0188413 A1 12/2002 Borg

FOREIGN PATENT DOCUMENTS

EP 1 300 250 A2 4/2003
GB 2 354 735 A 4/2001
JP 2002-14576 1/2002

* cited by examiner

*Primary Examiner*—Hoang Ngo
(74) *Attorney, Agent, or Firm*—Oblon, Spivak, McClelland, Maier & Neustadt, P.C.

(57) ABSTRACT

In an image forming apparatus detachably connecting an imaging process unit including a non-volatile memory, information recorded in the non-volatile memory is partially encrypted.

14 Claims, 23 Drawing Sheets

FIG.21

| | ENCRYPTION METHOD | TYPE OF DATA |
|---|---|---|
| ENCRYPTED AREA 5001 | ENCRYPTION KEY 1008 | TOTAL USE HISTORY,··· |
| ENCRYPTED AREA 5002 | ENCRYPTION KEY 1007 | RECYCLE AGENT DATA, SALES AGENT DATA |
| ENCRYPTED AREA 5003 | ENCRYPTION KEY 1006 | PRIVATE INFORMATION |
| NON-ENCRYPTED AREA 5004 | | REGULAR DATA |

IMAGE FORMING APPARATUS, IMAGING PROCESS UNIT, AND METHOD FOR RECORDING INFORMATION CONCERNING IMAGING PROCESS UNIT

BACKGROUND OF THE INVENTION

1. Field of the Invention

The present invention generally relates to image forming apparatuses, imaging process units, and methods for recording information concerning the image process units, in particular to an image forming apparatus detachably connectable to an imaging process unit, an imaging process unit possible to be mounted to the image forming apparatus, and a method for recording information concerning the image process unit in the image forming apparatus.

2. Description of the Related Art

Recently, there are many cases in that an IC (Integrated Circuit) tag is mounted to a process cartridge (imaging process unit) which configures an imaging unit forming a visualized image onto a photoreceptor of a copier and is easily detachable from a main unit. The IC tag not only reads out data (for example, an ID) but also accumulates a process condition, a use history, a defect history, a use environment, and a like.

For example, Japanese Laid-open Patent Application No. 2002-014576 discloses the invention related to an image forming apparatus including a control circuit for writing and reading data such as the use history, the process condition, and the like to/from a non-volatile memory mounted in the process cartridge detachably connected to the image forming apparatus. In the image forming apparatus, an encrypted text is generated by using an original document data and an encryption key in that the encryption key is generated based on data (special value for each unit) from a control circuit which does not generate the encryption key.

However, in the invention described in Japanese Laid-open Patent No. 2002-014576, only an encryption between the main unit and a printer is disclosed but data to write to the non-volatile memory are not considered. That is, in a case in that a third party extracts the process cartridge, data maintained in the non-volatile memory of the process cartridge may be leaked to an outsider and may be reused after the data are falsified.

However, in a case in that the process cartridge is distributed for a recycle or a like, the data in the non-volatile memory is easily read out and private data and a like can be leaked. In addition, if a malicious agent or a like intervenes for the recycle, product life data or a like recorded in the process cartridge may be falsified and may be sold in the disguise of a new process.

SUMMARY OF THE INVENTION

It is a general object of the present invention to provide image forming apparatuses detachably connectable to an imaging process unit, imaging process units possible to be mounted to the image forming apparatus, and methods for recoding information concerning the image process unit in the image forming apparatus, in which the above-mentioned problems are eliminated.

A more specific object of the present invention is to provide an image forming apparatus detachably connectable to an imaging process unit, an imaging process unit possible to be mounted to the image forming apparatus, and a method for recoding information concerning the image process unit in the image forming apparatus, which make it more difficult to leak and falsify information recorded in a non-volatile memory of a process cartridge or a like.

The above objects of the present invention are achieved by an image forming apparatus detachably connecting an imaging process unit including a non-volatile memory, wherein information recorded in the non-volatile memory is partially encrypted.

In the image forming apparatus according to the present invention, since the non-volatile memory of the image process unit is encrypted, it is possible to make it more difficult to leak and falsify the information.

The above objects of the present invention can be achieved by an imaging process unit detachably mounted to the image forming apparatus, and a method for recording information of the imaging process unit in the image forming apparatus.

BRIEF DESCRIPTION OF THE DRAWINGS

In the following, embodiments of the present invention will be described with reference to the accompanying drawings.

FIG. 21 is a diagram showing a structure of the non-volatile memory according to the fifth embodiment of the present invention;

DESCRIPTION OF THE PREFERRED EMBODIMENTS

In the following, an embodiment of the present invention will be described with reference to the accompanying drawings.

[First Embodiment]

Figure 1:
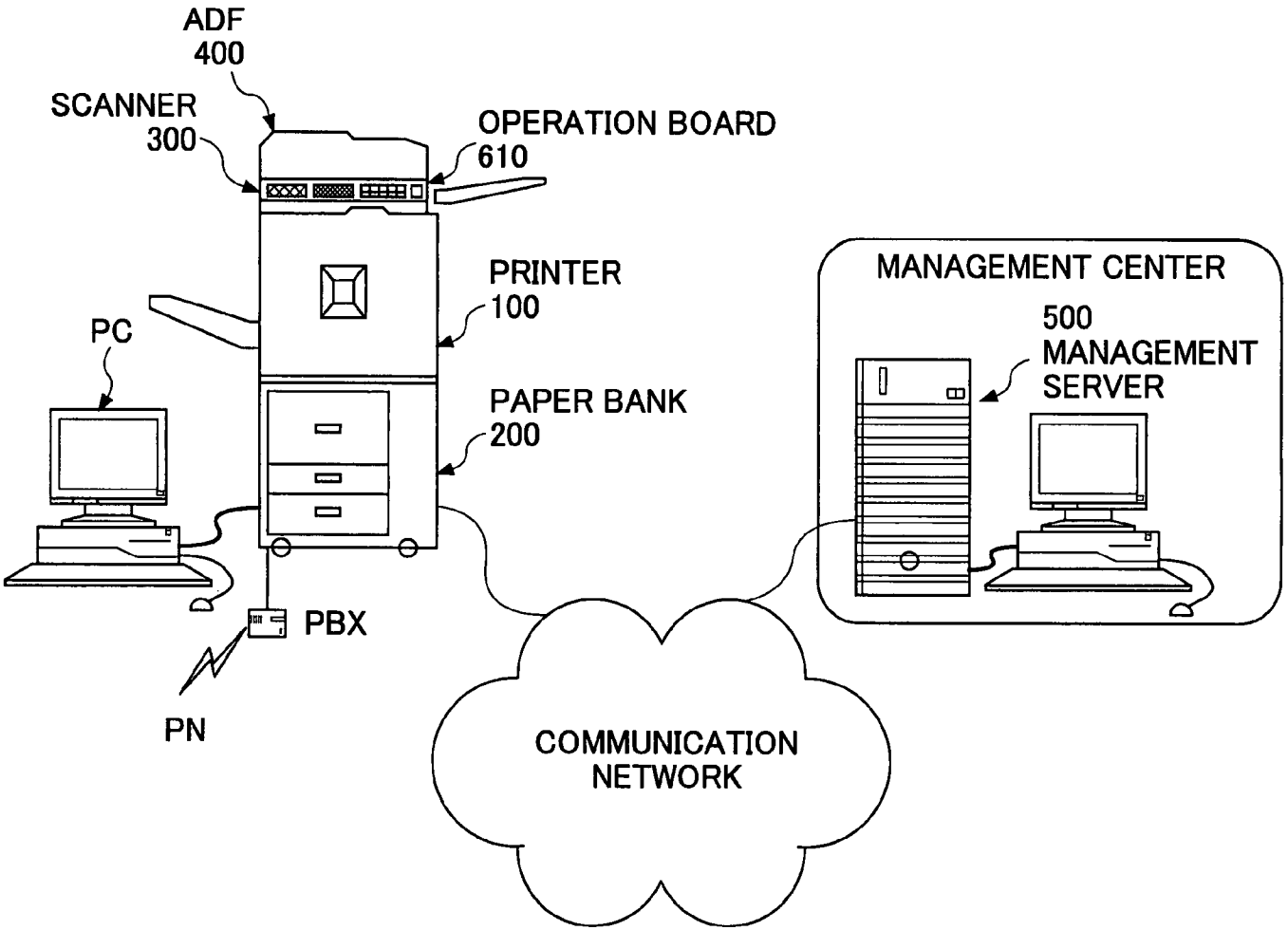
FIG. 1 is a diagram showing an appearance of the multi-functional full color digital copier according to a first embodiment of the present invention.

FIG. 1 is a diagram showing an appearance of the multi-functional full color digital copier according to a first embodiment of the present invention. This multi-functional full color digital copier (hereinafter, simply called full color copier) mainly includes an auto document feeder (ADF) 400, an operating board 610, a color scanner 300 (hereinafter, simply called scanner 300), a color printer 100 (hereinafter, simply called "printer 100"), and a paper bank 200. A system controller 630 (FIG. 3) is connected to a LAN (Local Area Network) connecting to a personal computer (PC). The system controller 630 (FIG. 3) of the full color copier can connect to a communication network (Internet), so that the full color copier can communicate to a management server 500 arranged in a management center and exchange data with the management server 500 through the communication network. Moreover, a facsimile control unit (FCU) (FIG. 3) in the full color copier can conduct a facsimile transmission through a switching unit such as a PBX (Private Branch Exchange) and a public communication network (PN).

Figure 2:
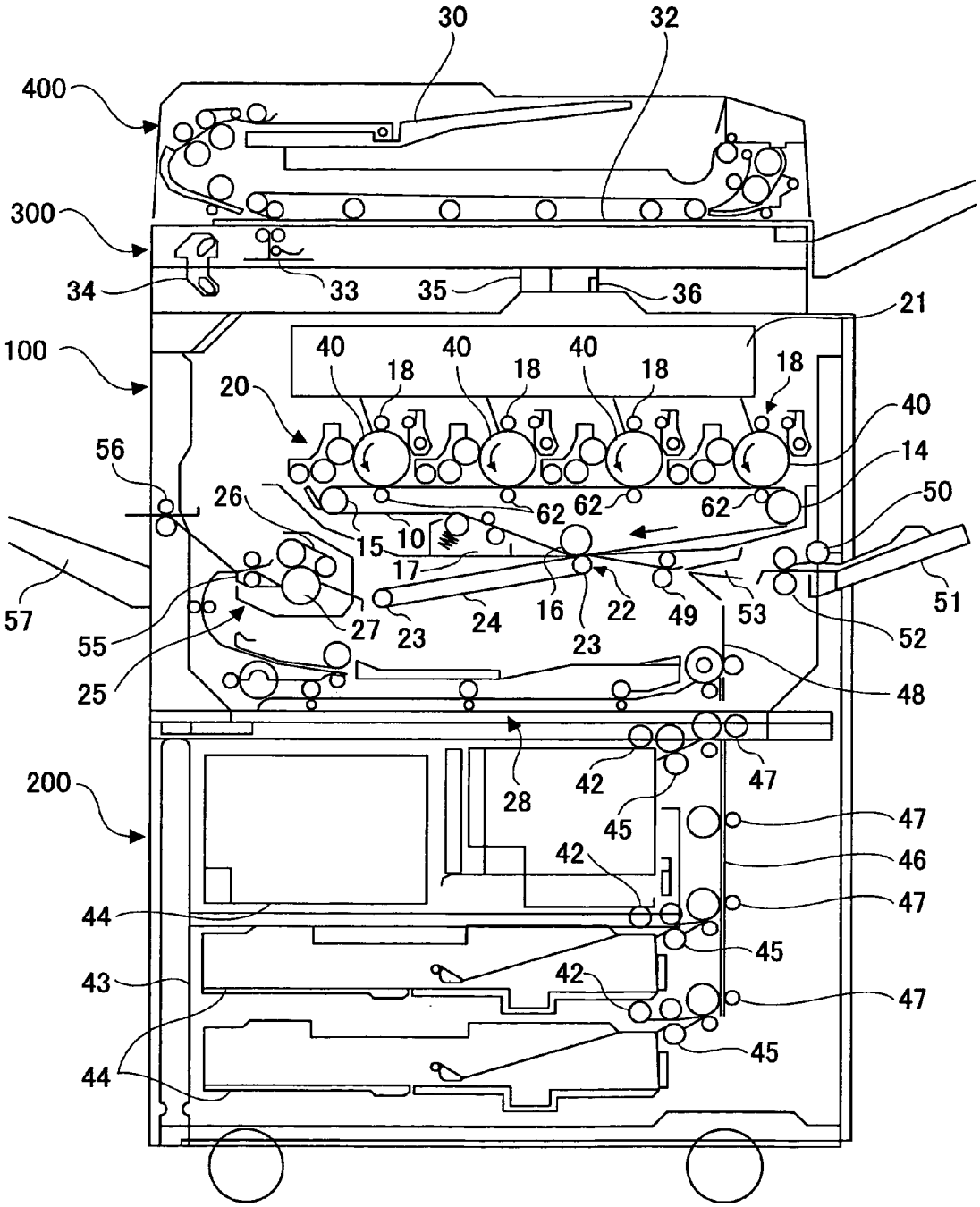
FIG. 2 is a schematic diagram showing a mechanical structure of the full color copier shown in FIG. 1, according to the first embodiment of the present invention.

FIG. 2 is a schematic diagram showing a mechanical structure of the full color copier shown in FIG. 1, according to the first embodiment of the present invention. In the printer 100 of the full color copier, an intermediate transfer belt 10 as a non-end belt is arranged in the center. The intermediate transfer belt 10 is provided around three supporting rollers 14 through 16, and is rotated in a clockwise direction. At a left side of a second supporting roller 15, an intermediate transfer body cleaning unit 17 is arranged to remove a residual toner residing on the intermediate transfer belt 10 after an image transcription.

Along a movement direction of the intermediate transfer belt 10 between a first supporting roller 14 and a second supporting roller 15, four color imaging devices for black (K), yellow (Y), magenta (M), and cyan (C) as image process units are arranged. Each of the four color imaging devices is a replaceable unit, and is detachably mounted to the main unit. Each of the four color imaging devices includes a photoreceptor drum 40, and includes an electronic charger for charging the photoreceptor drum, a developer for developing a latent image, an imaging related unit 18 formed by a cleaning unit and other peripheral units.

A laser exposing unit 21 for illuminating a laser beam is arranged above an imaging unit 20 to conduct an image formation onto each photoreceptor drum 40 of the four color imaging devices. The laser exposing unit 21 is also a replaceable unit.

Beneath the intermediate transfer belt 10 as the imaging process unit formed as the replaceable unit, a secondary transfer unit 22 as the imaged process unit formed as the replaceable unit is arranged. The secondary transfer unit 22 is arranged so that a secondary transfer belt 24 being a non-end belt is arranged between two rollers 23. The secondary transfer belt 24 transfers a image onto a paper sheet on the intermediate transfer belt 10. Beside the secondary transfer unit 22, a fixing unit 25 is arranged to fix a transferred image on the paper sheet, and the paper sheet on which a toner image is transferred is conveyed to the fixing unit 25.

The fixing unit 25 is also the imaging process unit and a replaceable unit. The fixing unit 25 is formed so that the fixing belt 26 being a non-end belt is pressed by a pressure roller 27 generating heat. Beneath the secondary transfer unit 22 and the fixing unit 25, a sheet reversing unit 28 is arranged to reverse and send out the paper sheet immediately after a image is formed on a front surface of the paper sheet, in order to record an image on a back surface of the paper sheet. The sheet reversing unit 28 is also the image process unit and is a replaceable unit.

In a case in that a start switch is pressed, when there is an original sheet on the ADF 400, after the original sheet is carried onto a contact glass 32, a scanner 300 is activated, and a first carriage 33 and a second carriage 34 are driven in order to scan the original sheet being placed on the contact glass 32. Also, when the original sheet is manually place on the contact glass 32, the scanner 300 is activated so as to scan the original sheet on the contact glass 32 in the same manner described above. Then, a light is emitted to the contact glass 32 from a light source on the first carriage 33 and also a reflected light from a surface of the original sheet is reflected at a first mirror on the first carriage 33 to direct toward the second carriage 34, is reflected at a mirror on the second carriage 34 to pass through an image-formation lens 35, and then images to a CCD (Charge Coupled Devices) 36 which is a read sensor. The each color record data of black (K), yellow (Y), magenta (M), and cyan (C) based on image signals obtained by the CCD 36.

When the start switch is pressed, the intermediate transfer belt 10 starts to rotate and also each of the four color imaging devices of the imaging unit 20 starts for an imaging preparation, and then an imaging sequence is started for each of the four color imaging devices. A relative exposure laser being modulated based on relative color record data is projected to each of the four color imaging devices, the toner image for each of the four color is transferred and overlapped onto the intermediate transfer belt 10 as a single image. When a forefront of the toner image enters a secondary transfer unit 22, a forefront of the paper sheet is sent to the secondary transfer unit 22 simultaneously, so that the toner image on the intermediate transfer belt 10 is transferred to the paper sheet. In this case, timing is measured for the forefront of the toner image and the forefront of the paper sheet to simultaneously enter the secondary transfer unit 22. The paper sheet to which the toner image is transferred is sent to the fixing unit 25, and the toner image is fixed on the paper sheet.

One of paper feeding rollers 42 of a paper bank 200 is selected and activated to rotate, the paper sheet is led out from one of paper feeding cassettes 44 provided to multistage in a paper bank 43, only one paper sheet is separated by separating rolls 45 to input the paper sheet to a paper feeding path 46, and the paper is conveyed by a conveying rollers 47 to lead to the paper feeding path 48 in the printer 100. The paper sheet is stopped at a registration roller 49, and then the paper sheet is sent to the secondary transfer unit 22 at the above-described timing. The paper sheet can be supplied by inserting it to a manual feed tray 51. When a user inserts the paper sheet to the manual feed tray 51, the printer 100 activates and rotates a paper feeding roller 50, so that one paper sheet is separated from a set of paper sheets on the manual feed tray 51 and is led into a manual paper feeding path 53. In the same manner, the paper sheet is stopped at the registration roller 49.

When the paper sheet is ejected after the fixing unit 25 conducts a fixing process to the paper sheet, the paper sheet is guided to a discharge roller 56 by a switching pawl 55 and is stacked on a discharge tray 57. Alternatively, the paper sheet is guided to the sheet reversing unit 28 by the switching pawl 55, is reversed, and is led to a transfer position to record an image on the back surface of the paper sheet. After the image is formed on the back surface of the paper sheet, the paper sheet is ejected onto the discharge tray 57 by the discharge roller 56.

On the other hand, the residual toner residing on the intermediate transfer belt 10 after the image is transferred is eliminated by an intermediate transfer body cleaning unit 17 and is recycled for the image formation.

Figure 3:
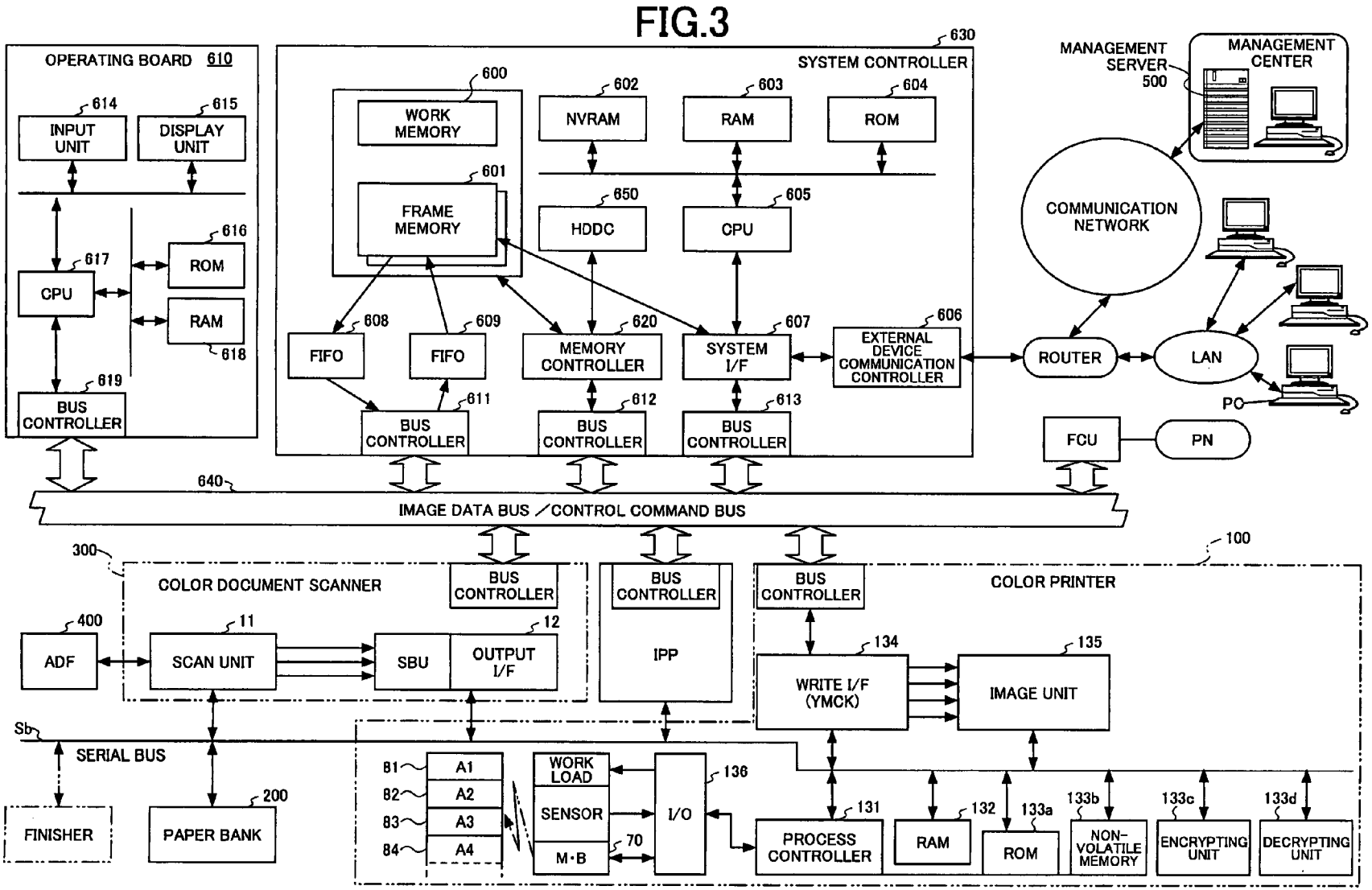
FIG. 3 is a diagram showing a system configuration concerning an image scan, an image process, an image accumulation, and an image formation of the full color copier shown in FIG. 1, according to the present invention.

FIG. 3 is a diagram showing a system configuration concerning an image scan, an image process, an image accumulation, and an image formation of the full color copier shown in FIG. 1, according to the present invention. A scan unit 11 for optically scanning a document in the scanner 300 scans the document by an illumination source, and images a document image to an SBU (Sensor Board Unit) of the CCD 36. A photoelectric transfer is conducted by the CCD 36 to a reflected light by light illumination with respect to the document image (that is, document), an R image signal (image signal for red), a G image signal (image signal for green), and a B image signal (image signal for black) are generated, and converted into RGB image data on the SBU, and a shooting correction is conducted for the RGB image data. Then, the RGB image data are output from an output I/F (interface) 12 to an IPP (Image Processing Processor) as an image data processing device.

The IPP conducts a separation (determination whether an image is a character area, or a picture area: image area separation), a background elimination, a scanner gamma conversion, a filter color correction, a magnification, an image process, a printer gamma conversion, and a gradation processing. The IPP is a programmable arithmetic processing part for conducting an image process. Image data are sent from the scanner 300 to the IPP, and the IPP corrects a signal deterioration (signal deterioration in a scanner system) accompanying with an optical system and a quantization to produce a digital signal. Then, the image data are written in the frame memory 601.

The system controller 630 includes a plurality of applications including a scanner application, a facsimile application, a printer application, a copy application, and a like, and control the entire system. The operating board 610 analyzes an input and displays settings of the system and status contents of the settings. An image data bus/control command bus 640 is used to transfer image data and a control command by time-sharing.

A CPU 605 of the system controller 630 conducts a control of the system controller 630. A control program of the system controller 630 is recorded in a ROM 604. A RAM 603 is a working memory used by the CPU 605. An NVRAM 602 is a non-volatile memory and manages information of the entire system.

An external device communication controller 606 communicates with an external device which sends a request (for example, a full color copier being the same type of the printer 100, an image scanner, a personal computer, a printer, and facsimile) for scanning an image, accumulating an image, printing an image, or a like, and controls a physical I/F for connecting to a network. When the external device communication controller 606 connected to the network receives data from the network, the external device communication controller 606 sends only contents of communication data to a system I/F 607, which is connected to a bus controller 613. The system I/F 607 conducts a logic conversion with respect to received data and sends the received data to the CPU 605 in accordance with a predetermined protocol. The CPU 605 processes the received data to which the logic conversion is conducted. When the CPU 605 sends data to the network, the data is sent to the system I/F 607, and the external device communication controller 606 in an inversed order of receiving data, and the data is sent out as an electronic signal.

The system I/F 607 conducts a transmission control concerning document scan data, facsimile receive data, and document data (print instruction) from a personal computer, and also conducts a conversion into image data for printing document data of the personal computer and transmits the image data, which all data are processed in accordance with an instruction of the CPU 605 within the system. A work memory 600 is used to develop an image to use for the printer 100 (conversion from the document data to the image data). The frame memory 601 temporarily stores the image data such as a read image and a write image which are immediately printed out in a status of successively supplying a power.

An HDDC 650 is formed by a hard disk drive (HDD) and a controller of the HDD, which are used an application database storing application programs of the system and unit energizing information of the imaging process unit of the printer 100, image data of the read image and the write image, and image database accumulating the document data. The image data and the document data may be a dot image which is encoded. A FIFO (First-In First-Out) buffer memory 609 converts a data transmission speed when an input image is written in the frame memory 601. That is, the FIFO buffer memory 609 temporarily accumulates data in order to absorb a difference between timing to send data and timing to receive data of a transmission source and a transmission destination, a difference between data amounts per transmission unit, a difference between transmission speeds, and a like. The FIFO buffer memory 609 receives data at transmission timing and a transmission speed of the transmission source, and sends data at transmission timing and a transmission speed of the transmission destination. Similarly, a FIFO buffer memory 608 conducts a speed conversion for the frame memory 601 to transmit the image data as an output image.

A memory controller 620 controls an input and an output of the image between busses between bus controls 611 and 612 for the frame memory 601 and the HDDC 650 without the control of the CPU 605. In addition, in response to a command received by an input unit 614 of the operating board 610, the memory controller 620 edits, process, or synthesize an image accumulated in the HDDC 650. The memory controller 620 reads out image information from the HDD of the HDDC 650 to the work memory 600 or the frame memory 601, edits the image to change a print direction of the image with respect to the paper sheet, rotate the image, combine the image with another image mainly by an operation of changing an image data address, converts a density to image data, and conducts an image trimming and synthesizes images. By writing the image information processed as described above, various image processes and edits can be conducted. An image read unit conducts a read magnification of the image, and an image write unit conducts a print magnification.

The CPU 617 connecting a bus controller 619 conducts an input/output control of the operating board 610. That is, the CPU 617 controls the input unit 614 to input data and controls a display unit 615 to output and display data. A ROM 616 records a control program of the operating board 610. A RAM 618 is a work memory used by the CPU 617. The input unit 614 is used by a user who operates input keys and an input panel of the operating board 610 to input system settings. The display unit 615 is used to display setting contents and a status of the system to the user, and includes a display indication lights and a display panel. A basic magnifying power adjustment values of a main scan and a sub scan is conducted by measuring a magnifying power by using a sample image in a system adjustment process.

Figure 4:
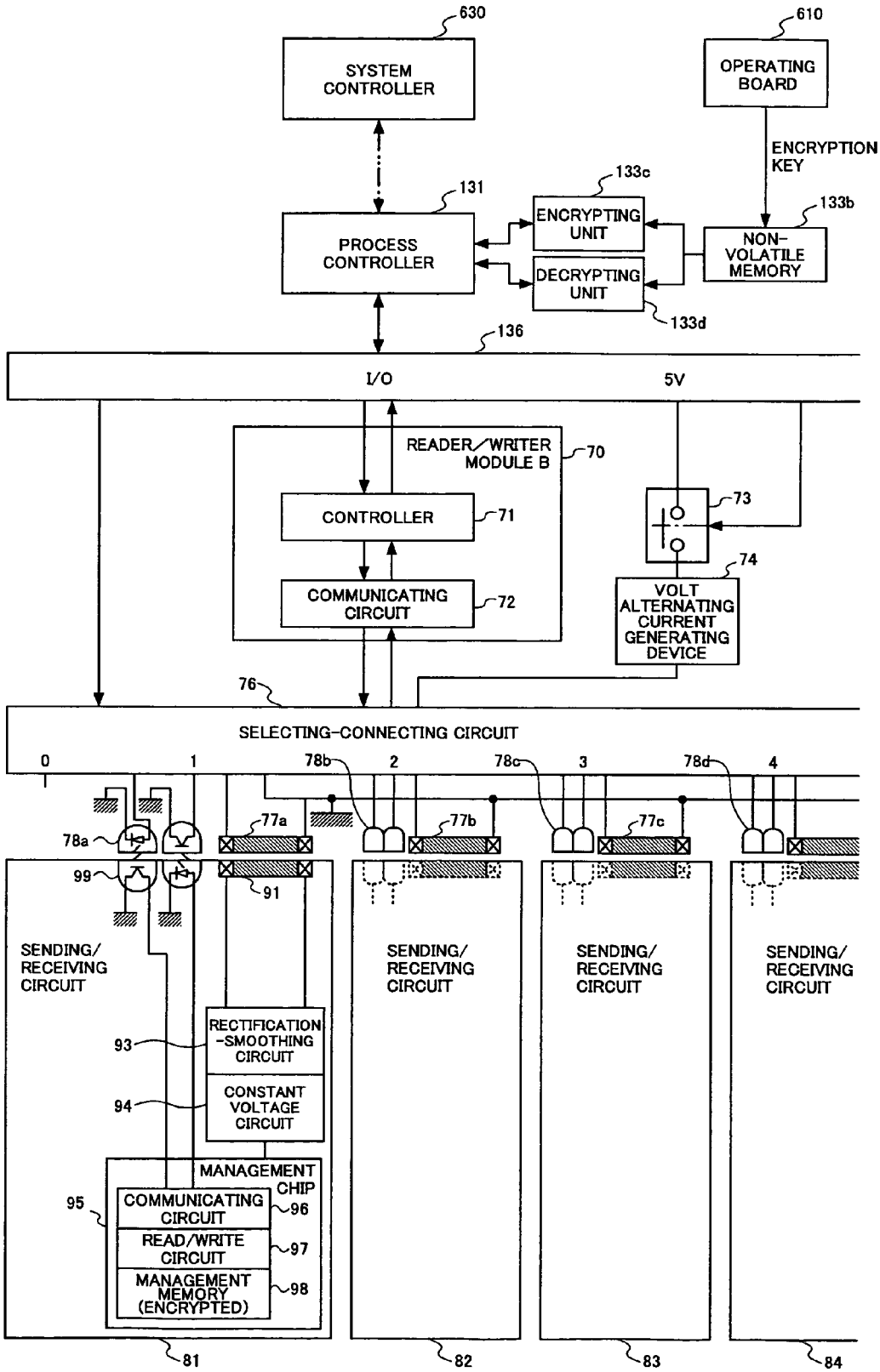
FIG. 4 is a schematic diagram showing a unit management information transmission system from each of the sending/receiving circuits embedded in respective imaging process units to the system controller shown in FIG. 3, according to the first embodiment of the present invention.

Each of the four color imaging devices (K, Y, M, and C) of the imaging unit 20, the laser exposing unit 21, the registration roller 49, the intermediate transfer belt 20, the secondary transfer belt 24, the fixing unit 25, and the sheet reversing unit 28 are detachably mounted as the imaging process units, respectively, to the main unit of the printer 100 shown in FIG. 2. The imaging process units include sending/receiving circuits 81, 82, 83, . . . (FIG. 3 and FIG. 4), respectively. In FIG. 4, a plurality of the sending/receiving circuits 81, 82, 83, . . . , that is, a plurality of the imaging process units are shown. However, it is not required to mount a plurality of the imaging process units in the print 100. The present invention can apply a case in that the printer 100 may include only one imaging process unit.

Referring to FIG. 3 again, a reader/writer module 70 receives management information sent from each of the sending/receiving circuits 81, 82, 83, . . . , and is connected to an I/O (Input and Output) 136. The I/O 136 is included in the printer 100 and is connected to a process controller 131 for controlling an image sequence of the imaging process unit. The process controller 131 energizes the imaging process unit or sets an operation based on control program recorded in a RAM 132, an energizing parameter of the imaging process unit, and timing data, and controls an operation sequence.

Each management memory 98 of the sending/receiving circuits 81, 82, 83, . . . (FIG. 4) stores the management information of the imaging process unit mounting the management memory 98. The management information includes a unit ID (a unit code and an individual code including a lot number and a product number), status information, an actual use value D, a product life setting value A, an ID and an address of the printer 100 (full color copier), and unit characteristic information individual for the unit, which are common information for all units. The secondary transfer belt 24 as a unit is required to have a higher precise control for a cause of a displacement in order to form a color image. As abasic data to conduct this control, the unit characteristic information showing characteristics such as a thickness, a resistance value, and a like of the secondary transfer belt 24 is divided into specific sections and is recorded in the management memory 98 for each section. In a case in that the photoreceptor drum and peripheral process units are formed as one unit, for each of the four color imaging devices, the unit characteristic information includes photoreceptor characteristic, an electrification roller characteristic, and a development characteristic. The unit characteristic information of the registration roller 49 includes characteristic identification information identifying a ground type or a bias type. In addition, in a case of the bias type, the unit characteristic information includes information showing a characteristic (a roller resistance, a surface resistance, and a like) as an indicator for defining a bias voltage. The unit characteristic information of the intermediate transfer belt 10 includes information showing a transfer characteristic of each color transfer roller or transfer blade. The unit characteristic information of the fixing unit 25 includes information showing a fixing characteristic (a fixing temperature, a power voltage, and an environment temperature).

FIG. 4 is a schematic diagram showing a unit management information transmission system from each of the sending/receiving circuits embedded in respective imaging process units to the system controller shown in FIG. 3, according to the first embodiment of the present invention. For example, the sending/receiving circuit 81 includes a management chip 95 being a micro-miniature for a radio transmission, a power receiving coil 91, a rectification smoothing circuit 93, and a constant voltage circuit 94, which are used to apply operation voltages. The power receiving coil 91 is arranged at an end surface of a unit case, is wound to a magnetic core so as to electrically coupled with a power supplying coil 77*a* tightly arranged at the main unit of the printer 100. The power receiving coil 91 is connected to the rectification smoothing circuit 93.

In the main unit of the printer 100, the power supplying coil 77*a* is arranged at a position facing to the power receiving coil 91 when the imaging process unit mounting the sending/receiving circuit 81 is mounted to the printer 100. In a case in that the imaging process unit is mounted to the main unit of the printer 100, the power receiving coil 91 faces to the power supplying coil 77*a* so far as to contact with the power supplying coil 77*a*. Each of the sending/receiving circuits 82, 83, . . . other than the sending/receiving circuit 81 also is configured in the same manner as the sending/receiving circuit 81. Power supplying coils 77*b*, 77*c*, 77*d*, . . . are arranged at the main unit of the printer 100 so as to face to respective power receiving coils of the sending/receiving circuits 82, 83, 84, . . . when the imaging process units are mounted to the main unit of the printer 100.

The power supplying coils 77*a*, 77*b*, 77*c*, 77*d*, . . . are connected to a first input/output port (1st pd), a second input/output port (2nd pd), . . . , a Nth input/output port (Nth pd), respectively. When the system controller 630 instructs the process controller 131 to read a status, the process controller 131 closes an open/close switch circuit 73. Then, in a selecting-connecting circuit 76, a voltage output is switched from a zero-th input/output port to the first input/output port, the voltage output is switched to the second input/output port when a data transmission for the sending/receiving circuit 81 of the imaging process unit coupled to the first input/output port ends, and the voltage output is switched to the third input/output port when the data transmission at the second input/output port ends. Then, when the data transmission ends after the voltage output is switched to the Nth input/output port, the open/close switch circuit 73 is opened.

While the open/close switch circuit 73 is closed, a volt alternating current generating device 74 generates a volt alternating current. First, an alternating current is applied to the power supplying coil 77*a* by the volt alternating current, and then the alternating magnetic field occurs. By this alternating magnetic field, the alternating current induces to the power receiving coil 91 of the sending/receiving circuit 81, and a smoothing capacitor of the rectification smoothing circuit 93 is charged. When the charging voltage of the smoothing capacitor achieves a predetermined value, the constant voltage circuit 94 starts to apply a voltage to the management chip 95.

In the sending/receiving circuits 81, a sending/receiving terminal 99 having a pair of light emitting diodes for sending a communication signal and a phototransistor for receiving the communication signal is arranged along with the power receiving coil 91, and a sending/receiving terminal 78*a* similar to and corresponding to the sending/receiving terminal 99 is arranged along with a power transmission coil 77*a* in the main unit of the printer 100. The sending/receiving terminal 99 of the imaging process unit and the sending/receiving terminal 78*a* of the main unit of the printer 100 form two pairs of photo couplers for sending and for receiving the communication signals. That is, an optical communication in the radio communication is conducted. The sending/receiving circuits 82, 83, . . . have the same configuration as the sending/receiving circuit 81.

A communication between the imaging process unit and the main unit in the printer 100 is not necessary to be the radio transmission. For example, in general, the imaging process unit and the main unit are directly connected to each other by a connector.

The process controller 131 sends a read instruction or a write instruction to the management chip 95. The management chip 95 reads data from the management memory 98 being an internal non-volatile memory in response to the read instruction, and sends out data to the process controller 131. Moreover, the management chip 95 writes data being transmitted by the process controller 131 to the management memory 98 in response to the write instruction to update contents of the management memory 98.

When the process controller 131 ends writing data to the management memory 98 as management data with respect to the first input/output port (coupled to the imaging process unit to communicate), next, the process controller 131 switches the selecting-connecting circuit 76 from the first input/output port to the second input/output port for a voltage output and a data transmission, and the data transmission is conducted to the sending/receiving circuit 82.

The process controller 131 sequentially conducts the same process until the Nth input/output port, which is the last input/output port set so as to write data, by switching the selecting-connecting circuit 76 for the data transmission to the image process units (to write data to each of the management memories 98 of respective image process units). When the process controller 131 ends the above described processes, the process controller 131 opens the open/close switch circuit 73.

The management memory 98 of the management chip 95 in the sending/receiving circuit 81 stores a management table Tp. In the first embodiment, data of the management table Tp are the management information including the unit ID (the unit code and the individual code including the lot number and the product number), the status information, the actual use value D, the product life setting value A, the ID and the address of the printer 100, and the unit characteristic information individual for the unit, as described above. Moreover, the management information may include a use condition of the imaging process unit. For example, an optimum value as condition values of a transfer voltage value, a development bias value, an electrification voltage value, and a like, and information such as chronological deterioration information of the photoreceptor, toner residual information, and a like which are chronically changed in use may be encrypted and be included in the management information.

The status information shows "new product", "in use", "defect", or "product life". The actual use value D shows a use number (equal to print number), and the product life setting value A shows a product life value in a design corresponding to the use environment.

A non-volatile memory 133*b* of the printer 100 (FIG. 3) includes a registration table Tm to which use management data of each of the image process units connected to respective input/output ports (1st pd through port Nth pd) of the selecting-connecting circuit are written. In the first embodiment, data for each of the input/output ports (1st pd through port Nth pd) shows the unit ID, the status information showing "in use", "defect", or "product life", an actual use value d (use number=print number), and an assigned product life value e. Moreover, an encrypted key (encryption code) input from the operating board 610 is registered to the non-volatile memory 133*b*. The non-volatile memory 113*b*, an encrypting unit 133*c*, and a decrypting unit 133*d* are connected to a bus Sb. The encrypting unit 133*c* encrypts the management information by using the encryption key, and the decrypting unit 133*d* decrypts encrypted management information to the management information by suing the encryption key.

For example, the encryption key maybe internally stored within the printer 100 as an individual encryption key for each printer. Alternatively, the encryption key may be obtained through the network. In this case, the user is not necessary to input the encryption key from the operating board 610. From a viewpoint of security, in order to limit using the encryption key maintained in the printer 100 (that is, to limit writing encrypted data to the management memory of the imaging process unit, and operating encrypted data maintained in the management memory), for example, instead of inputting the encryption key, a user is required to input a password, and the encryption key is allowed to use only when the user is successfully authenticated. In detail, only in a case of a service mode for a service person to use the printer 100 to conduct a maintenance check, the encryption key is allowed.

[Decrypting Process]

When the process controller 131 reads out the management information being encrypted from the management memory 98 of the management chip 95 of the sending/receiving circuit 81, the encryption key is read from the non-volatile memory 133*b* and loaded to the encrypting unit 133*d*. The transmission destination of the management information being encrypted in the management memory 98 is defined to be the decrypting unit 133*d*, and the decrypting unit 133*d* decrypts the management information by using the encryption key to send to the process controller 133. The above-process is a decrypting process for the management information in the first embodiment. The controller 131 sends the management information being decrypted to the system controller 630. The same decrypting process as the sending/receiving circuit 81 is conducted in each of the sending/receiving circuits 82, 83, 84, . . . .

[Encrypting Process]

When the management information is written to the management memory 98, the process controller 131 reads the encryption key from the non-volatile memory 133*b*, and loads the encryption key to the encrypting unit 133*c*. The transmission destination of the management information is defined to be the encrypting unit 133*c*, and the encrypting unit 133*c* reads the management information being encrypted. The above-described process is an encrypting process of the management information in the first embodiment. The management information being encrypted is written to the management memory 98. The same encrypting process as the sending/receiving circuit 81 is conducted in each of the sending/receiving circuits 82, 83, 84, . . . .

When the printer 100 being a new product is provided to a user, in principle, the status information of the management table Tp in each imaging process unit shows "new product", the actual use value D=0, the product life setting value A=the product life value in a design when the printer 100 is distributed, and the status information for each of the first input/output port through the Nth input/output port in the registration table Tm shows "in use", the actual use value d=0, and the assigned product life value e=product life setting value A. The product life setting value A is defined for each imaging process unit. Accordingly, the product life setting value A is different for each image process unit. However, the product life setting value A of the management table Tp of the imaging process unit coupled to the first input/output port is identical to the assigned product life value e registered for the first input/output port to the registration table Tm.

Figure 5:
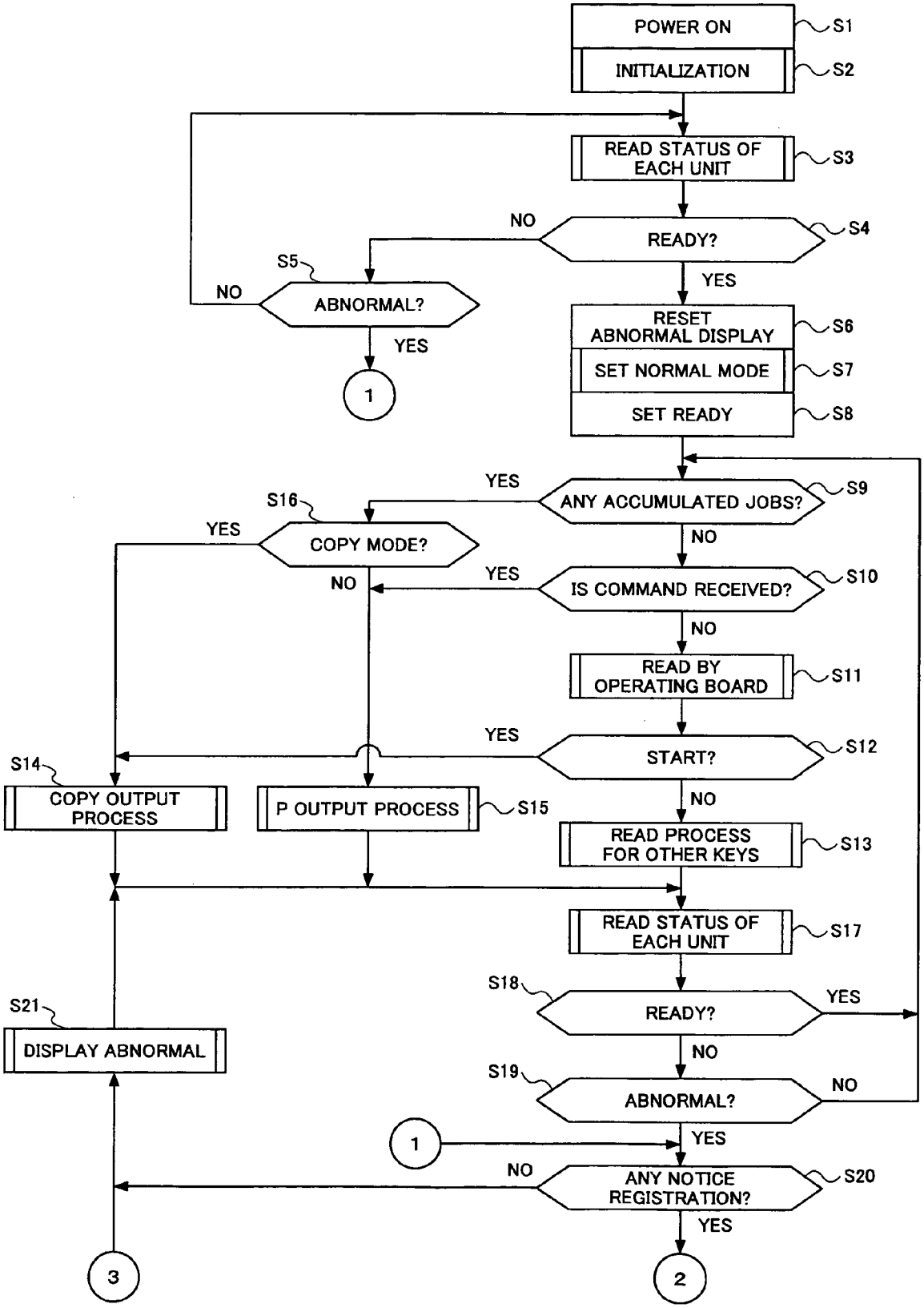
FIG. 5 is a flowchart briefly showing a part of a system control conducted by the system controller shown in FIG. 3, according to the first embodiment of the present invention.
Figure 6:
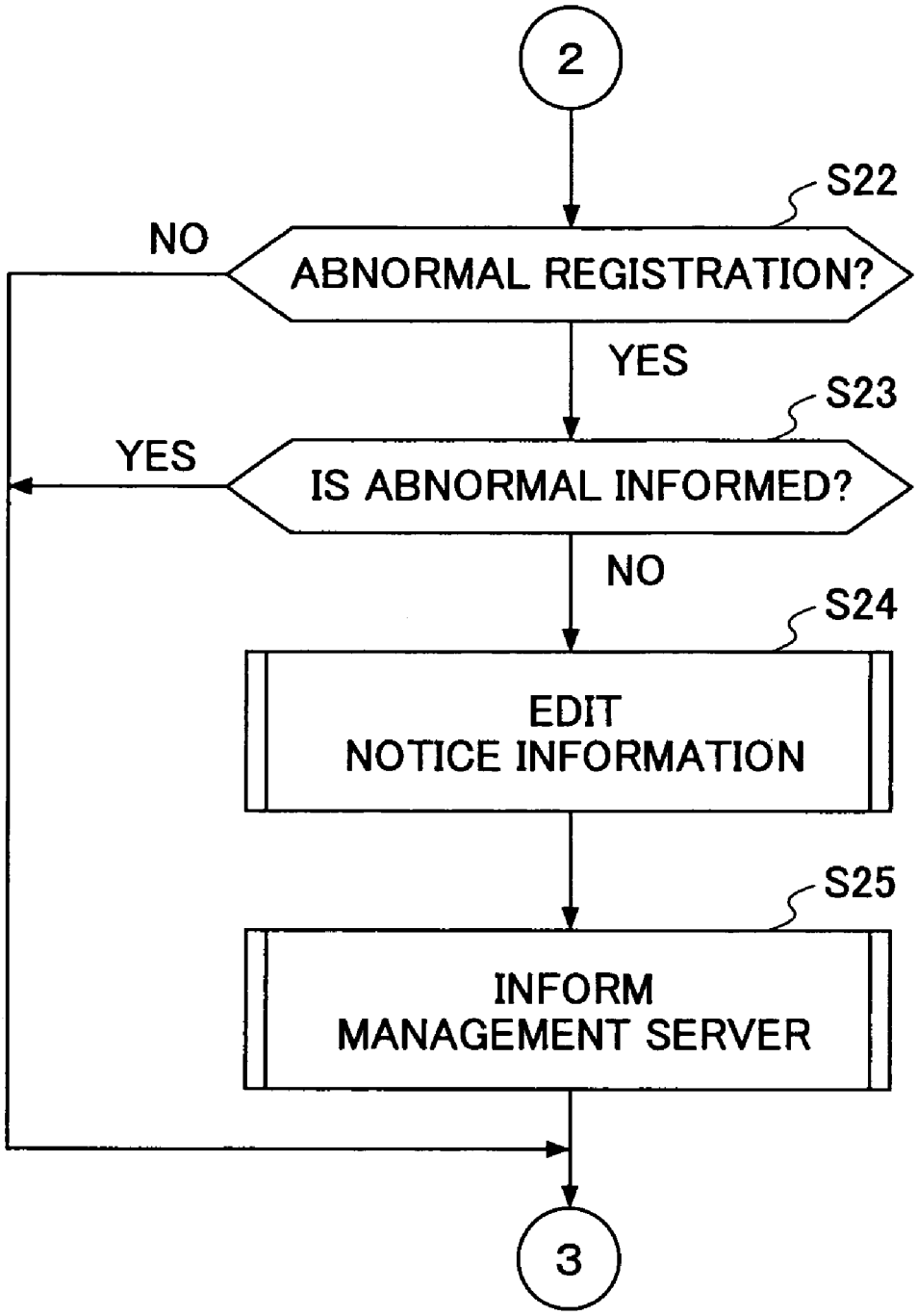
FIG. 6 is a flowchart briefly showing the part of the system control conducted by the system controller shown in FIG. 3, according to the first embodiment of the present invention.

FIG. 5 and FIG. 6 are flowcharts briefly showing a part of a system control conducted by the system controller shown in FIG. 3, according to the first embodiment of the present invention. First, referring to FIG. 5, an operation voltage is applied to the system controller 630 (step S1) the system controller 630 (CPU 605) clears output ports, initializes the RAM 603, and display "Please wait for a while" on a liquid crystal touch panel of the operating board 610 with blinking a red lump (step S2).

Next, the system controller 630 reads each status of units, and detect an abnormal state in that an error occurs (step S3). In the following, the abnormal state and a state requiring maintenance are collectively called abnormal state and shown as "ABNORMAL" in drawings. While the power is OFF, the imaging process unit may be replaced. In order to check whether or not the imaging process unit is replaced, in step S3 to read the status of each unit, step S3*a* shown in FIG. 7 to read unit information is conducted. Step S3*a* will be described later with reference to FIG. 7. In step S3, when a unit is in the abnormal state or needs maintenance (requiring to supply paper sheets, requiring a replacement of the unit, switching paper feeding cassette, or a like) it is checked whether or not a maintenance request notice is registered (notice registration) (step S20). When there is no registration, the abnormal state is displayed or contents of the maintenance request are set and displayed (step S21).

When the error is eliminated and the system controller 630 returns from a preparation loop in the abnormal state, the system controller 630 resets a display currently showing information concerning the abnormal state (step S6). When there is the notice registration, referring to FIG. 6, it is checked whether or not the abnormal state is an abnormal state registered in a maintenance request item table, which is assigned to an area in the NVRAM 602 (step S22). When the abnormal state is registered, the system controller 630 edits notice information to send to the management server 500 (step S24), and sends the notice information to the management server 500 of the management center (step S25). Then, the system controller 630 displays information concerning the abnormal state (step S21).

When the abnormal state is not registered, as an initialization condition of a copy process in a normal mode, the system controller 630 sets "copy number: 1", "automatic density", "automatic paper sheet selection", and "real size" (step S7). Then, the system controller 630 displays "READY TO COPY" at the display unit 615, switches from the red lump to a green lump to display at a start key, and sets a copy ready or a print ready (step S8). Then, the system controller 630 checks whether or not there are image data to output to an image memory area in the HDD of the HDDC 650 (step S9). When there is no image data to output, the system controller 630 waits until a print command is sent from a host PC or data are input to the operating board 610 and data are sent from the management server 500 (step S10). When a copy input is made while waiting, a document to copy is scanned (step S11) and a process corresponding to the copy input (setting a copy condition) is conducted (step S13).

When the operating board 610 detects that the start key is pressed in step S11 (read by operating board) the system controller 630 advances to step S14 (copy output process) (steps S12, S13, and S14). In summary, the copy output process in step S14 is the same as a regular copy process. When a copy of the document ends, the system controller 630 conducts check processes in steps S9, S10, S11, S12, and S13. When the print command is received from the host PC, the system controller 630 advances to step S15 (P output process, that is, printer output process) (in a flow of step S10 and step S15). In summary, the P output process in step S15 is the same as a regular printer output process. When the print output ends, the system controller 630 conducts the check processes in steps S9 through S13.

While the system controller 630 conducts the copy output process in step S14 and the P output process in step S15, when the system controller 630 receives another print command, the system controller 630 accumulates the print command and print document data to the HDD of the HDDC 650. Also, while the system controller 630 conducts the P output process in step S15, when a copy start key is pressed, the system controller 630 drives the ADF 300 and the scanner 300 and accumulates document image data to the image memory area in the HDD of the HDDC 650. Then, when the copy output process in step S14 or the P output process in step S15 being currently conducted by the system controller 630 ends, accumulated data in the HDD of the HDDC 650 are read out in an order of writing data, data read out from the HDD are sequentially printed out in the copy output process in step S14 or the P output process in step S15 (in a flow of steps S9, S16, and S14 or S 15).

While the copy output process in step S14 or the P output process in step S15 is executed, and while the system controller 630 is waiting a next command after the copy output process in step S14 ends or the P output process in step S15 ends, the process controller 131 reads a status (step S17) when the process controller 131 detects the abnormal status, the process controller 131 informs the abnormal status to the system controller 630. When the system controller 630 receives information showing the abnormal status, the system controller 630 checks whether or not there is "notice to service center" showing "1" (notice registration is made) in a maintenance communication table (step S20).

Referring to FIG. 6, when there is "notice to service center" showing "1" (notice registration is made) the system controller 630 further checks whether or not the abnormal status being currently recognized is registered (indicated) in the maintenance request item table (step S22) When the abnormal status being currently recognized is registered in the maintenance request item table, the system controller further checks whether or not the abnormal status being currently recognized has been already informed to the management server 500 (step S23). When the abnormal status being currently recognized has not been already informed to the management server 500, the system controller 630 edits data showing a copier (subject copier) ID (line number), an administrator ID (e-mail address and line number), the abnormal status, and a like in the maintenance communication table as a send information frame (step S24). Then, the system controller 630 communicates with the management server 500 of the management center, and sends the send information frame to the management server 500. That is, the system controller 630 sends the maintenance request notice to the management server 500. After that, the system controller 630 recognizes a reply from the management server 500 in a process for reading status of each unit in step S17 in FIG. 5.

Figure 7:
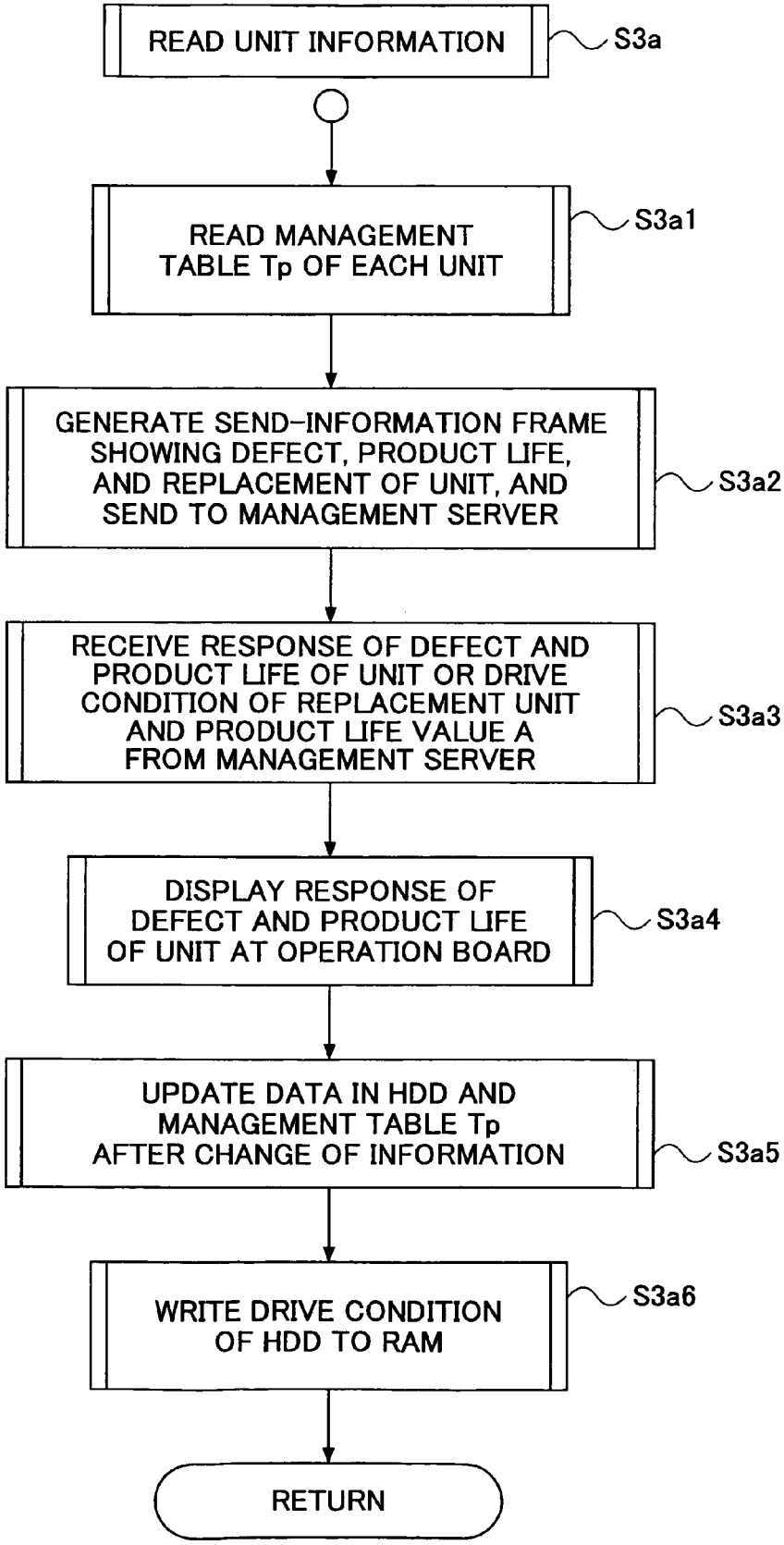
FIG. 7 is a schematic diagram showing step S3*a* to read unit information conducted in step S3 to read the status of each unit, according to the first embodiment of the present invention.

FIG. 7 is a schematic diagram showing step S3*a* to read unit information conducted in step S3 to read the status of each unit, according to the first embodiment of the present invention. The system controller 630 instructs the process controller 131 to read the management information (step S3*a*1). In response to this instruction, in step S32 to read the status of each unit shown in FIG. 9 through FIG. 12, the process controller 131 reads the management table Tb (management information, which is encrypted in this case) in the management memory 98 of the sending/receiving circuit 81 mounted in the image process unit, decrypts the management table Tp by using the decrypting unit 133*d*, checks by matching data being decrypted with data in the registration table Tm whether or not the imaging process unit is needed to replace, updating information in the management table Tp and the registration table Tm if necessary, and transmits the management information to the system controller 630 (step S3*a*1).

When the system controller 630 receives the management information, if the management information includes information concerning the imaging process unit such as "defect", "product life", or "already replaced (just after replaced)", the system controller 630 generates the send information frame to send the information concerning the imaging process unit, and sends the send information frame to the management server 500 through the network (the Internet) (step S3*a*2).

The management server 500 includes an energizing information extraction table storing a unit code of the unit ID of the imaging process unit, unit energizing parameters being the unit energizing information (such as a motor rotation speed, an applied voltage of an electrification roller, a development bias voltage, a primary transfer voltage for each color, a secondary transfer voltage, a bias voltage of a registration roller, a fixing target temperature, and other imaging parameters), and the product life setting value A, so that the unit energizing information and the product life setting value A correspond to the unit code. In addition, the management server 500 includes a management database for the copier ID (line number).

The energizing information extraction table is created for a broad section of the operation environment (for example, temperature, moisture, pressure, power supply voltage, voltage, stability of the voltage, and a like). Contents (the unit energizing parameters and the product life setting value A for unit characteristics) in the energizing information extraction table is partially changed depending on the operation environment. For example, the fixing target temperature for a cold district is different from the fixing target temperature for a warm district. For a power unstable district in that a power supply voltage for a business is low, a motor rotation speed and an energizing voltage are set to be higher. In addition, for an operation environment assumed that an environment is bad and the product life is quickly deteriorated, the product life setting value A is set to be short. The energizing information extraction table for the operation environment in a distinct where the management server 500 is located is stored as a database of the management server 500.

The management server 500 updates the management database for the copier ID (line number) of the printer 100 that sent the send information frame based on information received from the printer 100. When the information received from the printer 100 shows "defect" or "product life", the management server 500 sends process method report information of the management center or counter measure notice information for the user, order to response the information, to the system controller 630 (step S3*a*3). When information received from the printer 100 shows "already replaced" showing that the imaging process unit has already replaced, the management server 500 reads the unit energizing parameters and the product life setting value A for the unit code of the imaging process unit from the energizing information extraction table, and sends the unit energizing parameters and the product life setting value A to the system controller 630 (step S3*a*3).

The system controller 630 displays the process method report information or the countermeasure notice information received from the management server 500 at the operating board 610 (step S3*a*4), and writes the unit energizing parameters as a drive condition to the HDD of the HDDC 650. The system controller 630 writes the product life setting value A as the drive condition to the management table Tp through the process controller 131 to update the management table Tp (step S3*a*5). The unit energizing parameters written in the HDD is also written in the RAM 132 (step S3*a*6).

In an image formation by a copy or a print-out, the process controller 131 processes an imaging sequence by energizing the imaging process unit in accordance with the unit energizing parameters and the imaging control program which are read out from the HDD of the HDDC 650 and written in the RAM 132 in step S2 for the initialization. Accordingly, when the unit energizing parameters in the HDD and the RAM 132 in response to the above-described unit replacement, the imaging process unit is energized in accordance with the unit energizing parameters being updated.

Figure 8:
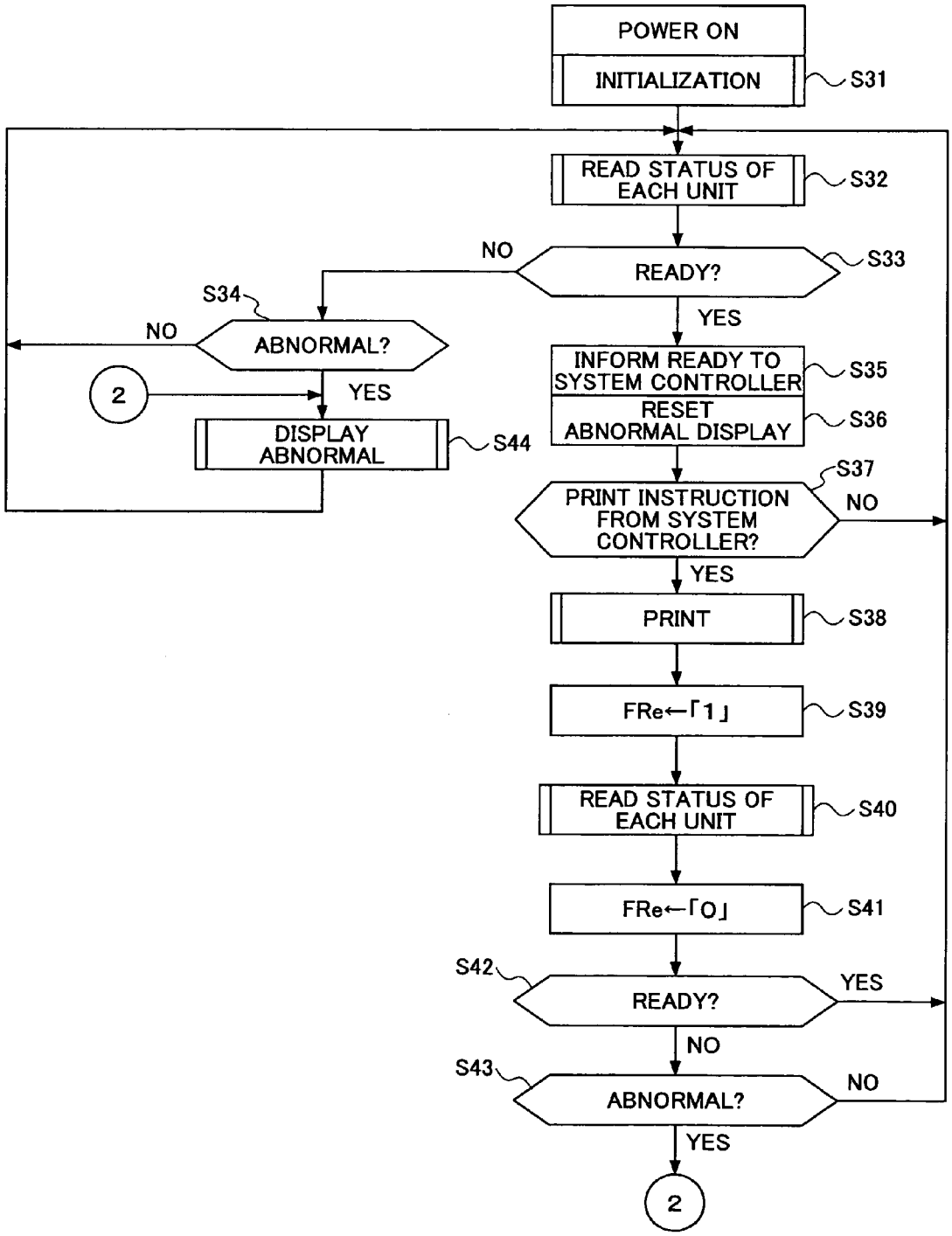
FIG. 8 is a diagram showing a brief control operation of the process controller 131 according to the first embodiment of the present invention.

FIG. 8 is a diagram showing a brief control operation of the process controller 131 according to the first embodiment of the present invention. When the operation voltage is applied to the process controller 131, the process controller 131 clears an output port and initializes the RAM 132 (step S31). Subsequently, the process controller 131 reads the status of each unit within the printer 100 (step S32). When the copy condition or the print condition is given from the system controller 630, the copy condition or the print condition is stored in the RAM 132, a mechanism or circuits within the printer 100 are set in accordance with the copy condition or the print condition given from the system controller 630. If the abnormal status or the state requiring maintenance (collectively called the abnormal state) occurs in the printer 100, the abnormal state is informed to the system controller 640, and is displayed at the operating board 610 (step S34 ad step S44). When there is no abnormal state, or when the abnormal state is solved, a ready state is informed to the system controller 630, so that a display showing the abnormal state is canceled (step S35 and step S36). When the print instruction (copy start or print start) is sent from the system controller 630, the process controller 131 conducts a control for a copy process or a print process in accordance with the copy condition or the print condition instructed from the system controller 630 (step S37 and step S38). Then, the process controller 131 writes a value "1" showing necessity of updating the actual use value of the image process unit to a register FRe (an area in the RAM) (step S39), and reads the status of each unit in the printer 100 (step S40).

In step S32 and step S40 to read the status of each unit in the printer 100, the process controller 131 conducts a data management for the management table Tp and the registration table Tm. Details of the data management will be described with reference to FIG. 9 in the following.

When step S40 to read the status of each unit ends, since the actual use value of the imaging process unit is updated in step S40 (step S53 and step S87 in FIG. 9), the process controller 131 initializes the register FRe so as to set data of the register FRe to be "0" (zero) (step S41). Next, when each unit is ready, that is, there is no abnormal state, in step S32 to read the status of each unit, the process controller 131 waits for the print instruction from the system controller 63. While waiting, the process controller 131 conducts a process corresponding to a change such as an open or a close of a front cover of the printer 100.

Figure 9:
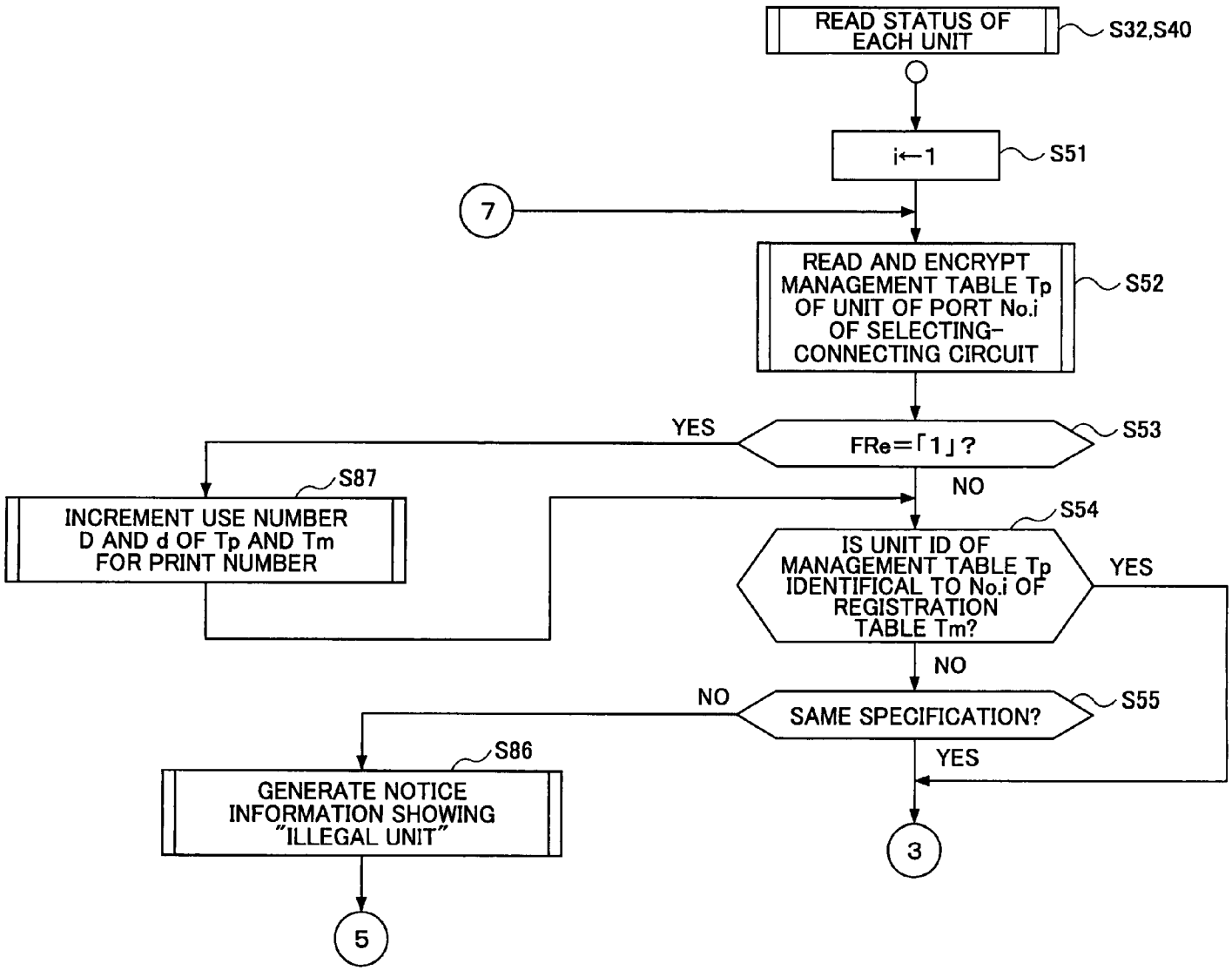
FIG. 9 is a flowchart for explaining an updating process for updating the management table Tp and the registration table Tm conducted when the process controller advances to step S32 or step S40 to read the status of each unit, according to the first embodiment of the present invention.
Figure 11:
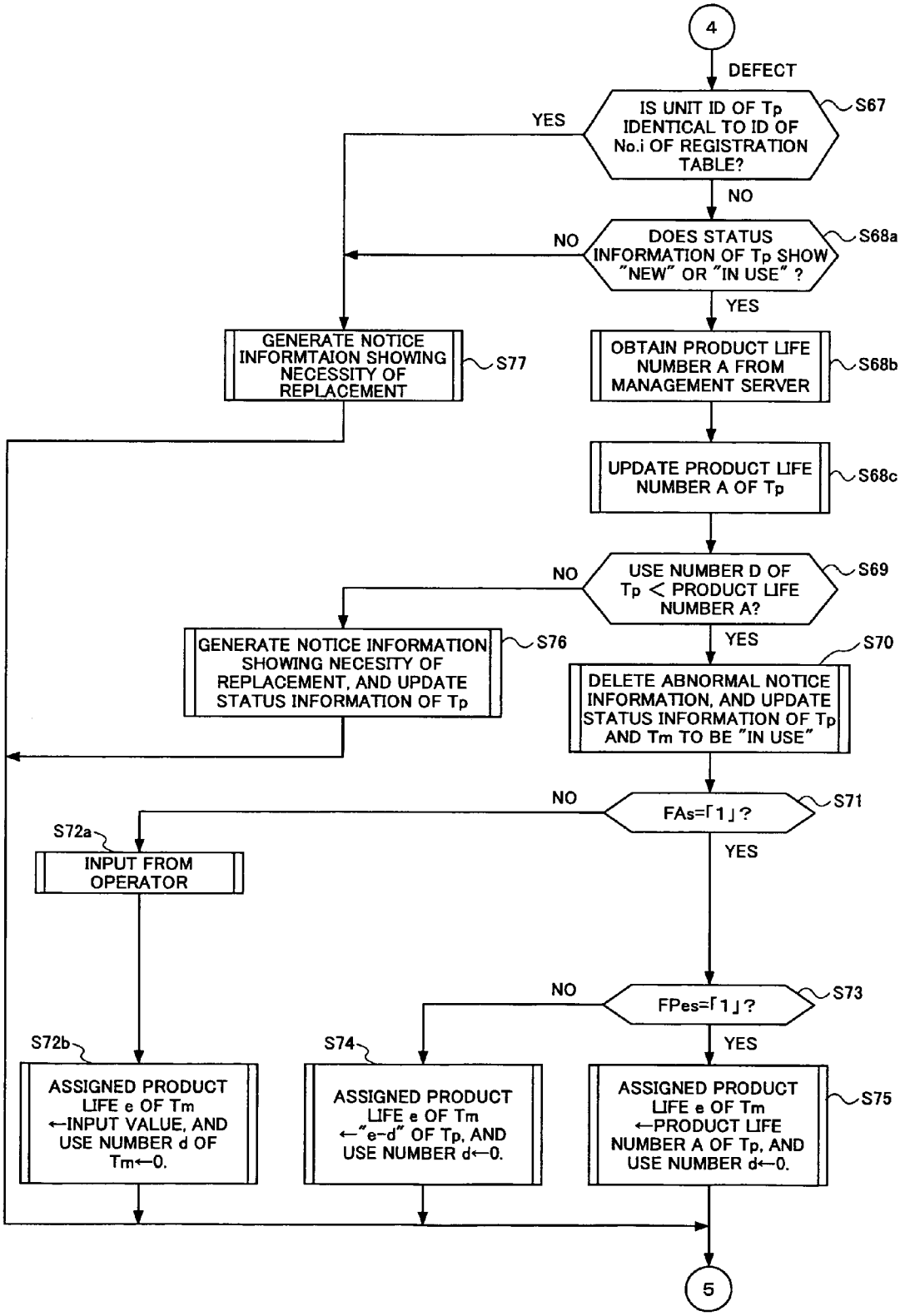
FIG. 11 is a flowchart for explaining the updating process for updating the management table Tp and the registration table Tm conducted when the process controller advances to step S32 or step S40 to read the status of each unit, according to the first embodiment of the present invention.
Figure 12:
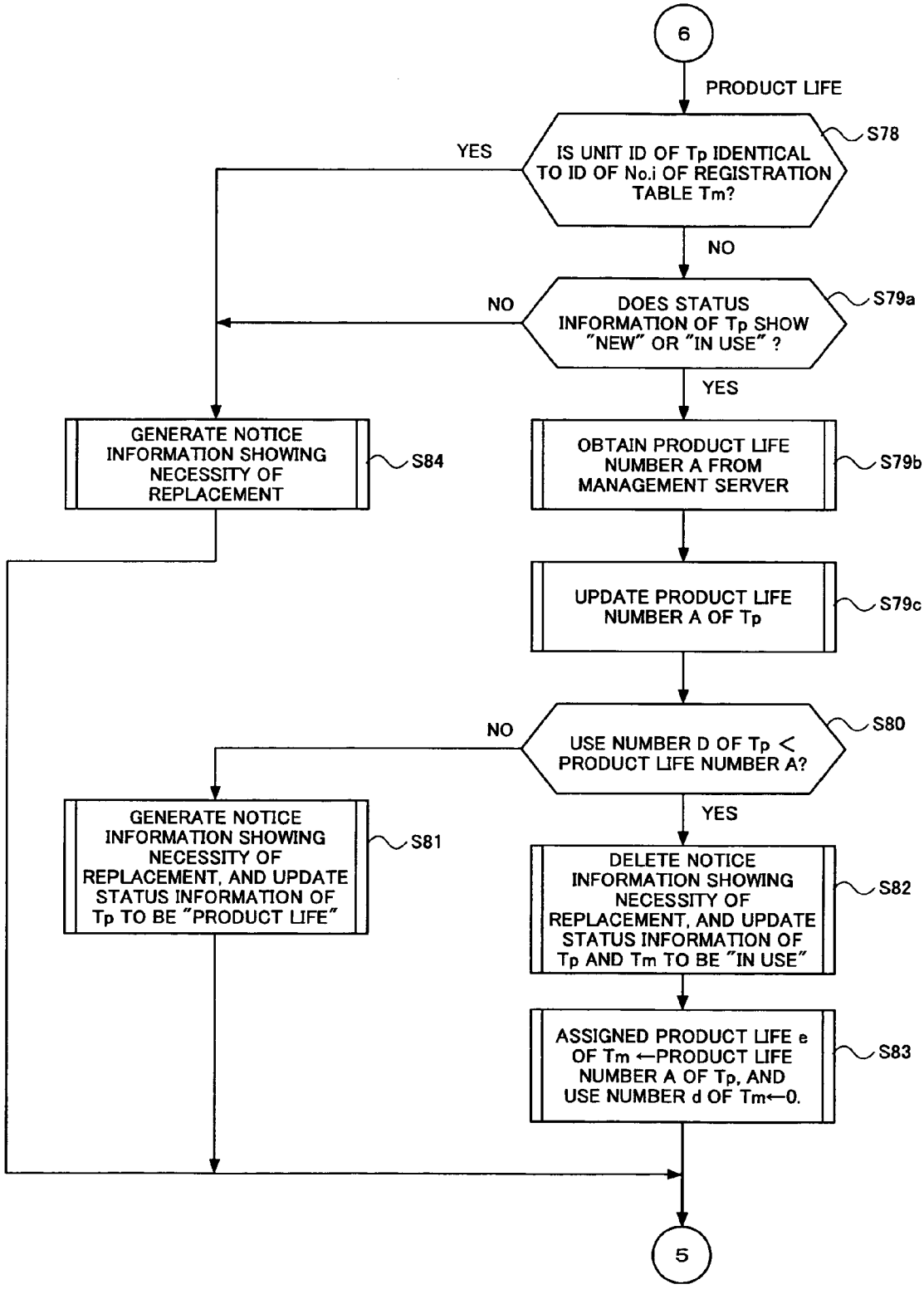
FIG. 12 is a flowchart for explaining the updating process for updating the management table Tp and the registration table Tm conducted when the process controller advances to step S32 or step S40 to read the status of each unit, according to the first embodiment of the present invention.

FIG. 9, FIG, 10, FIG. 11, and FIG. 12 are flowcharts for explaining an updating process for updating the management table Tp and the registration table Tm conducted when the process controller advances to step S32 or step S40 to read the status of each unit, according to the first embodiment of the present invention. In the updating process, the process controller 131 conducts the above-described decrypting process, so that the process controller 131 reads the unit ID, the status information, the actual use value D, and the product life setting value A from the management table Tp stored in the management memory 98 of the sending/receiving circuit 81 of the imaging process unit being coupled with the first input/output port of the selecting-connecting circuit 76, in step S51 and step S52. When the actual use value D of the image process unit is needed to update, that is, the print process has just conducted in step S38, the process controller 131 updates the actual use value D read from the management table Tp by adding the print number (the number of the image process) in the print process in step S38, and writes the actual use value D being updated to the management table Tp (before the encrypting process). Simultaneously, the process controller 131 updates the actual use value d for the first input/output port in the registration table Tm by adding the print number (step S53 and step 87).

Next, the process controller 131 matches the unit ID of the management table Tp with the ID for the first input/output port of the registration table Tm. When the unit code in the ID is not identical, the process controller 131 generates report information showing "illegal unit" to report it to the system controller 630 (step S55 and step S86). Next, the process controller 131 switches to the second input/output port of the selecting-connecting circuit 76 to read and write next management table Tp (step S63 and step S64 in FIG. 10). In the same manner, the process controller 131 reads the management table Tp of the imaging process unit coupled to the second input/output port and updates the actual use values D and d (steps S52, S53, and S54).

Figure 10:
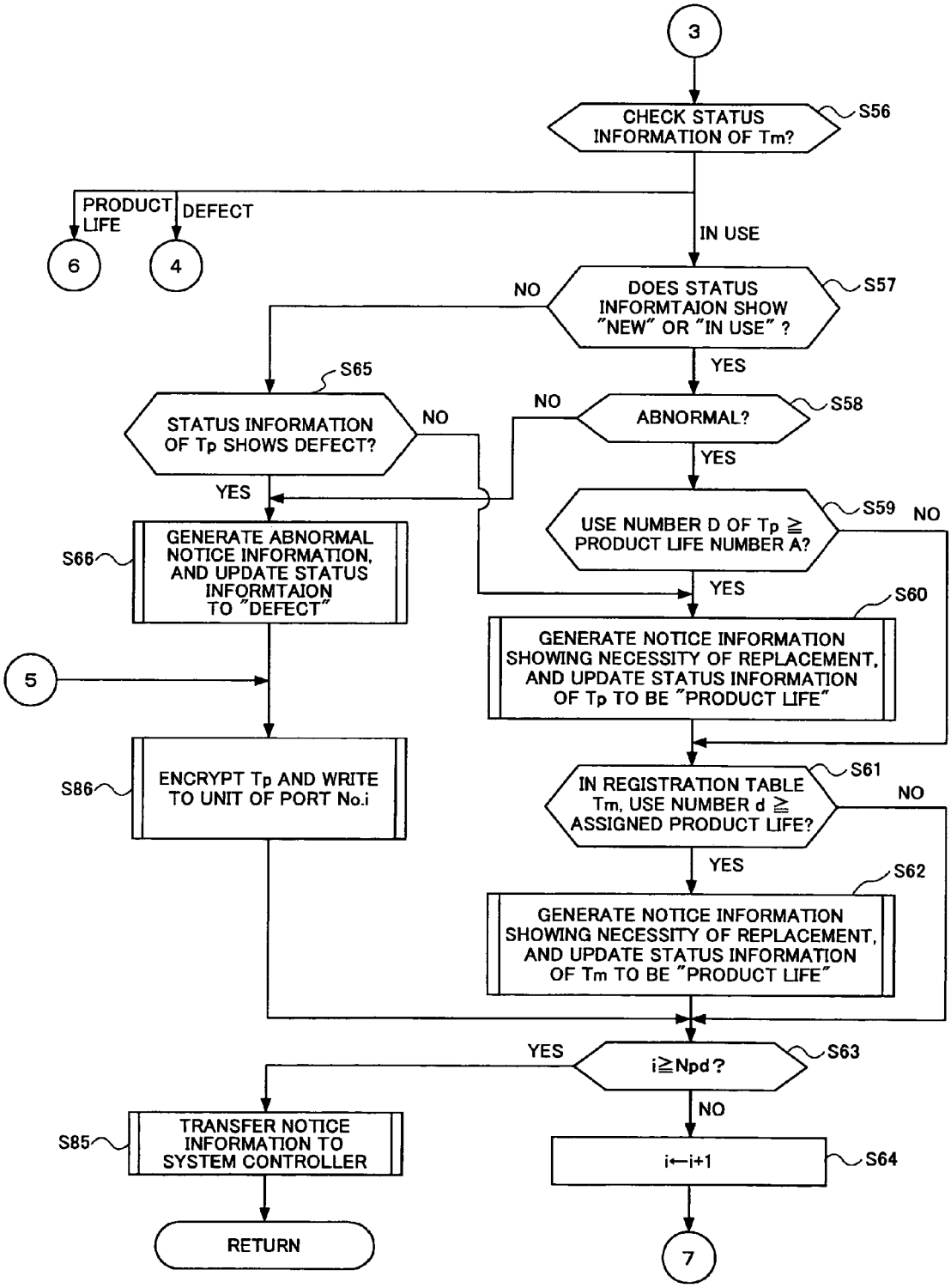
FIG. 10 is a flowchart for explaining the updating process for updating the management table Tp and the registration table Tm conducted when the process controller advances to step S32 or step S40 to read the status of each unit, according to the first embodiment of the present invention.

Next, referring to FIG. 10, when the unit code of the unit ID is identical, it is determined that a proper imaging process unit is mounted. The process controller 131 refers to the status information for the first input/output port of the registration table Tm (step S56). When the status information shows "in use", the process controller 131 conducts an actual use management (steps S57 through S66 in FIG. 10).

That is, the status information of the management table Tp (the management information before encrypted) of the image processing unit of the fist input/output port is "new" or "in use" which shows that the imaging process unit is allowed to use. When there is no defect in the imaging process unit, and when the actual use value D of the management table Tp is greater than or equal to the product life setting value A of the imaging process unit, the process controller 131 generates the notice information showing "necessary to replace a unit" to send it to the system controller 630, and updates the status information of the management table Tp to show "product life" (step S57, S58, and S60). In addition, when the actual use valued d for the first input/output port in the registration table Tm is greater than or equal to the assigned product life value e, the process controller 131 generates the notice information showing "necessary to replace a unit" and updates the status information for the input/output port in the registration table Tm to show "product life" (step S61 and step S62). When the actual use value D<the product life setting value A and the actual use value d<the assigned product life value e, since the imaging process unit of the first input/output port is not needed to replace, the process controller 131 does not update the management table Tp and the registration table Tm, and does not generate the notice information, but the process controller 131 reads out a next management table Tp of the imaging process unit of the second input/output port (steps S57, S58, S59, S61, S63, S64, and S52).

However, when it is determined that the imaging process unit of the first input/output port has a defect, the process controller 131 generates abnormal notice information for the system controller 630, and updates each of the status information for the first input/output port of the management table Tp and the registration table Tm so as to show "defect" (step S58 and step S66). In addition, when the status information read from the management table shows "defect", similarly, the process controller 131 generates the abnormal notice information for the system controller 630, and updates each of the status information for the first input/output port of the management table Tp and the registration table Tm to show "defect" (steps S57, S65, and S66). In a case of updating data (before encrypted) of the management table Tp, the process controller 131 conducts the above-described encrypting process with respect to the data of the management table Tp, and writes the data being encrypted to the management memory 98 of the sending/receiving circuit 81 coupled to the first input/output port (step S86).

The notice information to the system controller 630 is sent from the process controller 131 to the system controller 630 when each management table Tp of all imaging process units coupled to the first input/output port through the Nth input/output port, respectively, is read out and all actual use values are completely updated (step S63 and step S85). When the notice information is received by the system controller 630, since the imaging process unit for which the notice information is sent is needed to replace, the printer 100 does not proceed the imaging process until the replacement is made, and moves in a replacement waiting state (a mode of a waiting state for recovering from the abnormal state or a like).

When the user or the service person opens the front cover of the printer 100, replaces the imaging process unit with another (new) imaging process unit, and closes the front cover, in response to a change from a state of opening the front cover to a state of closing the front cover, the process controller 131 and the system controller 630 read the status of each unit.

In this case, the status information of the registration table Tm, which is read out from the management table Tp, shows "defect", these open and close of the front cover can be considered as a replacement of the image process unit having a defect. In this case, the process controller 131 updates the management table Tp and the registration table Tm for the replacement of the imaging process unit after "defect" is registered as shown in FIG. 11 (steps S56, and S67 through S77). However, when the status information of the imaging process unit shows "product life", these open and close of the front cover of the printer 100 can be considered as the replacement of the imaging process unit which product life is expired or nearly expired. In this case, the process controller 131 updates the management table Tp and the registration table Tm in response to the replacement of the imaging process unit (steps S56, and S78 through S84).

Referring to FIG. 11, when the status information of the registration table Tm, which is read out from the management table Tp for respective input/output port, shows "defect", and the ID (unit code and individual code) is identical, since the replacement of the imaging process unit is not conducted even if "defect" is informed, the process controller 131 generates the notice information showing "necessary to replace a unit" for the system controller 630s (steps S67 and S77). In a case in that the ID is not identical (the unit code is identical but the individual code is not identical), since the imaging process unit is replaced, when the status information of an imaging process used to replace shows "new" or "in use" showing usable, the process controller 131 provides the management table Tp of the imaging process unit used to replace to the system controller 630. The system controller 630 sends information provided from the process controller 131, to the management server 500 by the same communication process as the communication process conducted in step S3*a* to read unit information shown in FIG. 7. The management server 500 sends the unit energizing parameters corresponding to the unit code and the actual use value D of the unit ID of the management table Tp and the product life setting value A corresponding the unit codes to the system controller 630. The system controller 630 writs the unit energizing parameters to the HDD of the HDDC 650, and writes and updates the product life setting value A to the management table Tp corresponding to the imaging process unit through the process controller 131. In addition, the system controller 630 writes the unit energizing parameters, which is written to the HDD, to the RAM 132. In this process, the process controller 131 writes and updates the product life setting value A, which the system controller 630 received from the management server 500, to the management table Tp of the imaging process unit used to replace (steps S68*a* through S68*c*).

Then, when the actual use value D of the management table Tp is less than the product life setting value A, both the status information of the registration table Tm and the status information of the management table Tp are updated to show "in use" (steps S67 through S70). On the other hand, when the actual use value D is more than or equal to the product life setting value A, since a previous imaging process unit impossible to use has been replaced, the notice information showing "necessary to replace a unit" to the system controller 630 is generated and the status information of the management table Tp is updated to show "product life" (step S69 and S76).

It is assumed that the previous imaging process unit is replaced with a proper imaging process unit. Steps S67 through S70 in that both the status information of the management table Tp and the status information of the registration table Tm are conducted just after the previous imaging process unit is replaced with a new imaging process unit since the previous imaging process unit has a defect. For the printer 100, an expiration date for the new imaging process unit is set as the assigned product life value e after the replacement.

In the first embodiment, when "automatic" is set, either one of a guaranteed remained value mode and a unit life setting mode is selected. In the guaranteed remained value mode, the actual use value d of the imaging process unit having a defect is deducted from the assigned product life e (e=designed product life value A, when there is no defect previously) to be generally compensated so as to calculate a difference value c (that is, C=e−d) (c=A−D, when there is no defect previously), and the difference value c is set as the assigned product life value e. In the unit life setting mode, the product life setting value A of the imaging process unit used for a replacement is set as the assigned product life value e. On the other hand, when "automatic" is set, a value input by an operator is set as the assigned product life value e.

That is, in the registration table Tm of the non-volatile memory 113*b*, for each of the first input/output port through the Nth input/output port of the selecting-connecting circuit 76, a setting indication register FAs and an assigned value indication register FPes are assigned. In a case in that the setting indication register FAs shows "1" indicating "automatic", when the assigned value indication register FPes shows "1" indicating "setting product life", the process controller 131 updates the assigned product life value e to be the product life setting value A and the actual use value d is initialized to be a reference value "0" (zero) (steps S71, S73, and S75). When the assigned value indication register FPes shows "0" indicating "guaranteed remained value", the assigned product life value e is updated to be the difference value c obtained by deducting the actual use value d from the assigned product life value e when the imaging process unit fails to operate (c=e−d), and the actual use value d is initialized to be the reference value "0" (zero) (steps S71, S73, and S74).

In a case in that the setting indication register FAs shows "0" indicating "automatic", the process controller 131 informs a display request of an input screen for urging the operator to input a use number, which is assigned to the image process unit used for a replacement, to the system controller 630. The system controller 630 transfers the display request to the operating board 610, and the operating board 610 displays the input screen for inputting the assigned product life value at the liquid crystal panel of the display unit 615. When the operator inputs a numeral value to an input area of the assigned product life value and touches an enter key on the input screen, the numeral value is informed as an input value to the process controller 131 through the system controller 630. The process controller 131 updates the assigned product life value e by the input value and initializes the actual use value d to be the reference value "0" (zero) (steps S71, S72*a*, and S72*b*).

Settings to the setting indication register FAs and the assigned value indication register FPes will be described later with reference to FIG. 13.

Referring to FIG. 12, an updating process (steps S56, and S78 through S84) for updating the management table Tp and the registration table Tm to correspond to the replacement of the imaging process unit after "product life" is registered in the registration table Tm will be described. FIG. 12 is a flowchart for explaining the updating process in response to the replacement of the imaging process unit according to the first embodiment of the present invention. When the status information corresponding to the input/output port and read from the management table Tp shows "product life", the process controller 131 advances from step S56 in FIG. 10 to step S78 in FIG. 12. When the ID (unit code+individual code) of the registration table Tm is identical to the ID of the management table Tp, it is determined that the imaging process unit is not replaced, regardless of informing "product life". Accordingly, the process controller 131 generates notice information showing "necessary to replace a unit" for the system controller 630 (steps S78 and S84). On the other hand, when the ID is not identical (the unit code is identical but the individual cone is not identical), since the imaging process unit has been replaced, the process controller 131 sends a data update request and the management table Tp corresponding to the imaging process unit used for a replacement to the system controller 630 when the status information of the imaging process unit used for a replacement (in the management table Tp) shows "new" or "in use". The system controller 630 sends the data update request and the management table Tp received from the process controller 131 to the management server 500. The management server 500 sends the unit code of the unit ID of the management table Tp, the unit energizing parameters corresponding to the actual use value D, and the product life setting value A corresponding to the unit code. The system controller 630 writes the unit energizing parameters to the HDD of the HDDC 650, and writes the unit energizing parameters to the management table Tp of the imaging process unit to update. In addition, the system controller 630 writes the unit energizing parameters written in the HDD to the RAM 132. In this process, the process controller 131 writes the product life setting value A, which the system controller 630 received from the management server 500, to update the management table Tp of the imaging process unit used for a replacement (steps S79*a* through S79*c* in FIG. 12).

When the actual use value D of the management table Tp is less thatn the product life setting value A, both the status information of the registration table Tm and the status information fo the management table Tp are updated to show "in use" (steps S78 through S82). The assigned product life value e is updated to be the product life setting value A and the actual use value d is initialized to be the reference value "0" (zero) (step S83.

When the actual use value D is more than or equal to the product life setting value A, since the imaging process unit impossible to use has been replace, the process controller 131 generates the notice information showing "necessary to replace a unit" for the system controller 630, and updates the status information of the management table Tp to show "product life" (step S81).

Referring to FIG. 10 again, as described above, when the process controller 131 ends all processes for reading the management table Tp of the imaging process unit, and for conducting "use management of the imaging process unit" by matching information of the management table Tp with information of the registration table Tm corresponding to the image process unit for all imaging process units coupled to respective input/output ports (1st pd through Nth pd) of the selecting-connecting circuit 76, the process controller 131 sends the notice information generated during the above-described all processes, to the system controller 630 (steps S63 and S85). Then, the system controller 630 displays information concerning the notice information at the operating board 601. In response to this display, the user or the service person conducts a process such as a replacement of the imaging process unit, or a like. When a status of the front cover is changed such that the user or the service person opens and closes the front cover of the printer 100 (status change), the process controller 131 read the status of each unit, and conduct again the above-process "use management of the imaging process unit" within the process for reading status of each unit.

In general, the assigned product life value e registered in printer 100 is identical to the product life setting value A showing a product life of the imaging process unit as one unit. In a case in that both the assigned product life value e and the product life setting value A, it is considered that the imaging process unit is took out from the printer 100 before the product life is expired and the same or another imaging process unit is mounted and used in the printer 100.

As described above, in a previous imaging process unit being use prior to the expiration of the product life, when the abnormal state such as a unit failure or a like occurs and it is determined that the imaging process unit is impossible to use, the operating board 610 displays information concerning the abnormal state or a like, and then the printer 100 is mechanically stopped. After this, when the imaging process unit is replaced, the process controller 131 calculates a remained use number (that is, guaranteed remained value c=A−d) based on the product life setting value A and the used number d. In accordance with a predetermined settings, in a case in that the predetermined settings show this number, that is, the assigned value indication register FPes shows "1", this number is set to be the assigned product life value e (=C=A−d) set in the printer 100 for each imaging process unit. In a case there is no use history for the imaging process unit used for a replacement, when only this number is used, the process controller 131 determines that the guaranteed product life is expired, and stops the printer 100. In this case, the printer 100 mounts the imaging process unit having a different remained product life from a designed product life for the imaging process unit.

In the printer 100, when the imaging process unit having the remained product life is replace with a new imaging process unit, the process controller 131 sets the product life setting value A of the new imaging process unit to be the assigned product life value e being set in the printer 100.

In practical use, when the imaging process unit is failed before the product life setting value A, another imaging process unit is temporarily supplied to the user, and the user replaces with and uses another imaging process unit only for the remained number c=A−d, so that the user can use another imaging process unit appropriately for an amount of payment by the user. Alternatively, after the service person collects the imaging process unit having a defect, the service person can confirm the remained product life (=A−D) based on the actual use value D and the product life setting value A of the imaging process unit. Accordingly, the service person can supply another imaging process unit to the user for the remained product life (=A−D) in order to guarantee the entire product life setting value A of the imaging process unit. Moreover, in a case in that the user replaces another imaging process unit lent to compensate the remained product life (=A−D) with a new imaging process unit, the new imaging process unit can be used until the product life setting value A.

Next, details will be described with reference to FIG. 13 for the process for reading other key in step S13, which the system controller 630 conducts by using the operating board 610 in step S11 in FIG. 5, when keys other than the start key are operated. FIG. 13 is a flowchart for explaining the details of the process for reading other key in step S13 in FIG. 5, which is conducted by the system controller, according to the first embodiment of the present invention. While the system controller 630 is waiting, then an initialization setting key of the operating board 510 is pressed, a first page (initialization setting menu No. 0) of a setting menu is displayed at the liquid crystal touch panel of the operating board 610 (steps S91 and S92). The system controller 630 reads data, which are input by the operator to the operating board 610 (step S93). The initialization setting menu No. 0 includes "selecting and setting a unit use number" as a process indication. When the user touches "selecting and setting a unit use number", the liquid crystal touch panel of the operating board 610 displays "automatic/manual" as an indication key, "product life/shortage of product life" as a key for selecting settings at trouble, and the enter key. When the operator touches "automatic" or "manual" of "automatic/manual" as the indication key, and the operator touches "product life" or "shortage of product life" of "product life/shortage of product life", input information input by the operator is sent from the operating board 630 to the system controller 630. The system controller 630 encodes information sent from the operating board 610 to be write data ("1", "0") suitable for the setting indication register FAs and the assigned value indication register FPes, and registers the write data to the registration table Tm of the non-volatile memory 133*b* through the process controller 131 (steps S94 through S102).

Moreover, the initialization setting menu No. 0 includes "management and output of registration information" as a process indication key. When the operator touches "management and output of registration information", the system controller 630 displays a display screen in a scrolling form for the management table Tp and the registration table Tm at the liquid crystal touch panel of the operating board 610, and sends a request of the management table Tp and the registration table Tm to the process controller 131. In response to this request, the process controller 131 reads and encrypts the management table Tp of each of the imaging process units coupled to the first input/output port through the Nth input/output port, through the selecting-connecting circuit 76, and then transfer the management table Tp to the operating board 610 through the system controller 630. The operating board 610 displays data concerning the management table Tp at a table display screen (step S103 and step S104). When the operator touches "print" in a taskbar at the table display screen, the system controller 630 instructs the process controller 131 to print out in a case in that the process controller 131 informs that the printer 100 is ready to print (printable), so that display information is converted into image data for a print and sent out. Accordingly, the operator can a print of the display information (steps S105 through S107).

Furthermore, the initialization setting menu No. 0 includes "update encryption key" as an item. When the operator touches the "update encryption key" as the item, the system controller 630 instructs the operating board 610 to display a code update screen for displaying an encryption key being registered in the non-volatile memory 133*b* at the liquid crystal panel. When the operator appropriately modifies the encryption key displayed at the liquid crystal panel and touches an enter key on the code update screen, the system controller 630 transfers the encryption key being modified to the process controller 131, and additionally provides the encryption key being modified as a new encryption key to data which are informed to the management center. The process controller 131 maintains the encryption key (new encryption key). For each sending/receiving circuits 81, 82, 83, . . . , the process controller 131 reads the management table Tp and conducts the decrypting process for the management table Tp. Subsequently, the process controller 131 conducts the encryption process with respect to decrypted data of the management table Tp, by using the new encryption key, and then writes the management table Tp to respective sending/receiving circuit to update. That is, the process controller 131 replaces a current management table Tp of each of the sending/receiving circuits 81, 82, 83, . . . with the management table Tp encrypted by the new encryption key. Then, the process controller 131 updates the encryption key currently recorded in the non-volatile memory 133*b* to be the new encryption key.

Moreover, the initialization setting menu No. 0 includes "register to management center" as a process indication. When the operator touches "register to management center" as the process indication, the system controller 630 instructs the operating board 610 to display a screen for setting a communication between the printer 100 and the management server 500 of the management center based on a maintenance agreement between the administrator of the printer 100 and the management center at the liquid crystal panel. When a notice is registered to the management server 500, first, the operator inputs "1" to an input item for "notice to management center". Then, the operator inputs a line number and an IP address of PBX of the management server 500 of the management center that provides a maintenance service, and a telephone number (telephone communication number) for a voice conversation to phone to the management center, into a column "administrator". Next, the operator inputs a line number and an IP address of a personal computer or a facsimile of the administrator of the printer 100, and a telephone number (telephone communication number) for a voice conversation to phone to the administrator, into a column "administrator". Moreover, the operator inputs a line number and IP address of the PBX 45 of the printer 100, and a telephone number (telephone communication number) for a voice conversation, into a column "subject apparatus". When the operator selects "inquiry", the operator selects and indicates, as a method for receiving inquiry information from the management server 500, any one of an e-mail of a personal computer connected to the printer 100, a display at the liquid crystal panel of the operating board 610 of the printer 100, and a print out from the printer 100, by inputting an ID (line number) as an output destination. The method selected and indicated by the operator is written for the initialization setting menu No. 0 in the NVRAM 602. Hereinafter, a memory area recording the above-described data inputted by the operator are called maintenance communication table. When the operator touches "register" key on a screen showing initialization setting menu No. 0, the system controller 630 sends the maintenance communication table, a maintenance request item, and the encryption key (if indicated) to the line number of the management center (of the management server 500) through the external device communication controller 606 (steps S33 through S36). The management server 500 writes each table, list, and the encryption key for the printer 100 as a sender to a maintenance registration memory (database) being an internal memory of the management server 500. When the encryption key is updated, regardless of the above-described registering process, the encryption key being updated is sent to the management center at timing to communicate with the management center. Then, the encryption key registered in the management center is updated.

When the operator touches a "close" button on the screen of the operating board 610, the system controller 630 closes the screen for the initializing setting menu No. 0 (step S108).

When the printer 100 or the imaging process unit mounted as a part of the printer 100 are collected, at the management center, it is possible to read out and decrypt the management information (management table Tp) of the image process unit by using the encryption key registered in the management center.

According to the first embodiment of the present invention, even if the imaging process unit is took out from the main unit, since information in the non-volatile memory of the imaging process unit is encrypted, it is possible to make it difficult to leak or falsify information. However, security against to a leak or a like of the individual information can be improved. Therefore, it is possible to maintain liability of internal information of the imaging process unit in a case in that the imaging process unit is recycled.

[Second Embodiment]

A hardware configuration of the printer 100 in a second embodiment is the same as the hardware configuration of the printer 100 in the first embodiment. However, in the second embodiment, a function for generating the encryption key is different from the function for generating the encryption key in the first embodiment. That is, instead of the operating board 610, the system controller 630 generates the encryption key based on a copier ID (printer ID), and each unit ID included in respective management information of the imaging process units having respective sending/receiving circuits 81, 82, 83, . . . , and registers the copier ID and each unit ID to the management center. In the second embodiment, the system processor 630 defines data showing a product E obtained by multiplying copier ID data M with individual ID data Pi (i=1, 2, 3, . . . ) of each of the imaging process units, as an encryption key code.

Each of the imaging process units having the sending/receiving circuits 81, 82, 83, . . . includes an encrypted area for storing the management information in the management memory 98.

Figure 14:
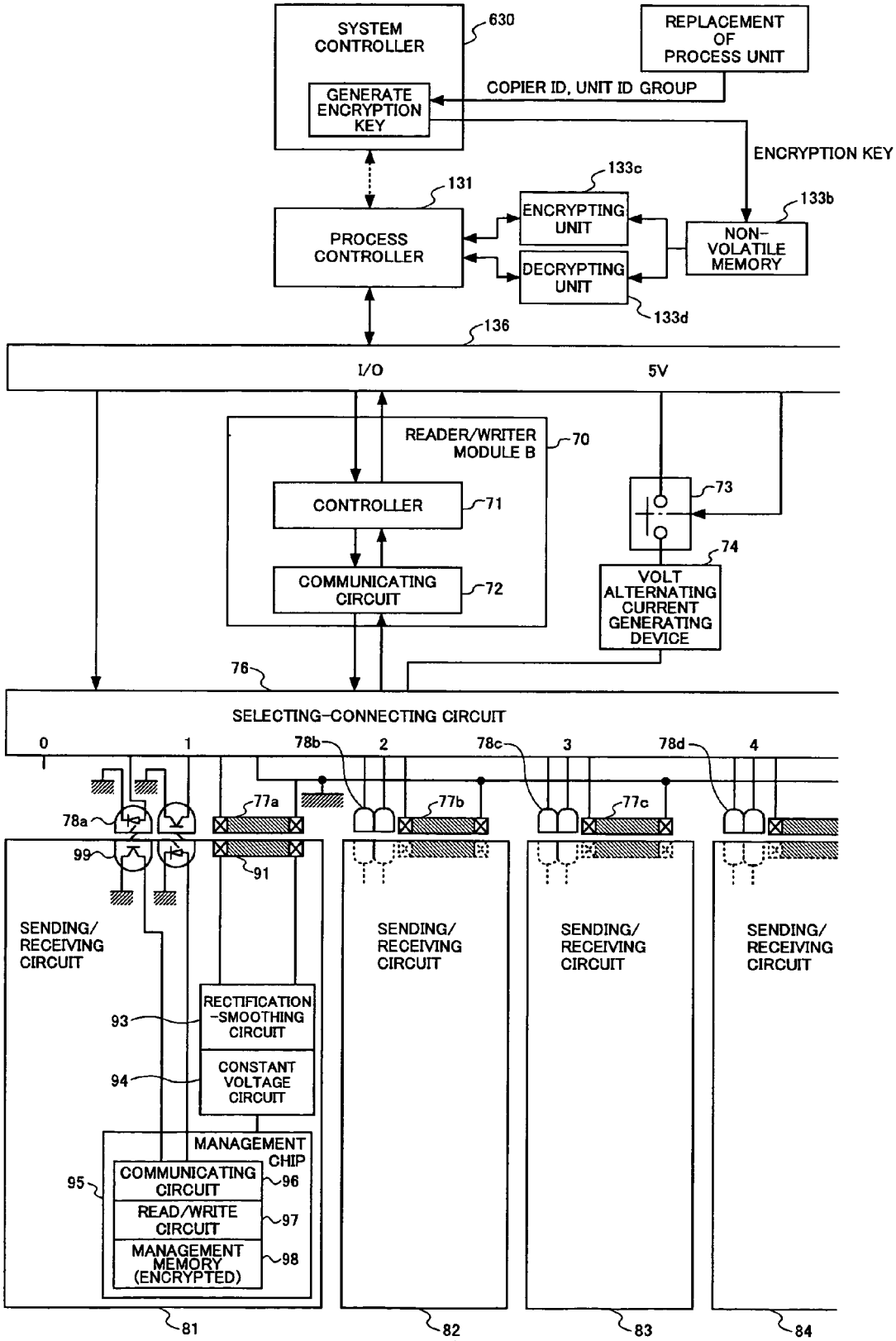
FIG. 14 is a schematic diagram showing a unit management information transmission system according to a second embodiment of the present invention.

A unit management information transmission system from the sending/receiving circuits 81, 82, 83, . . . to the system controller 630 will be briefly described with reference to FIG. 14. FIG. 14 is a schematic diagram showing the unit management information transmission system according to the second embodiment of the present invention. The system controller 630 generates an encryption key based on the copier ID (printer ID) and all unit IDs of the imaging process units. Accordingly, the encryption key is newly generated and registered to the non-volatile memory 133*b*, and is sent to the management center to register the encryption key each time any one of the imaging process units is replaced.

Figure 15:
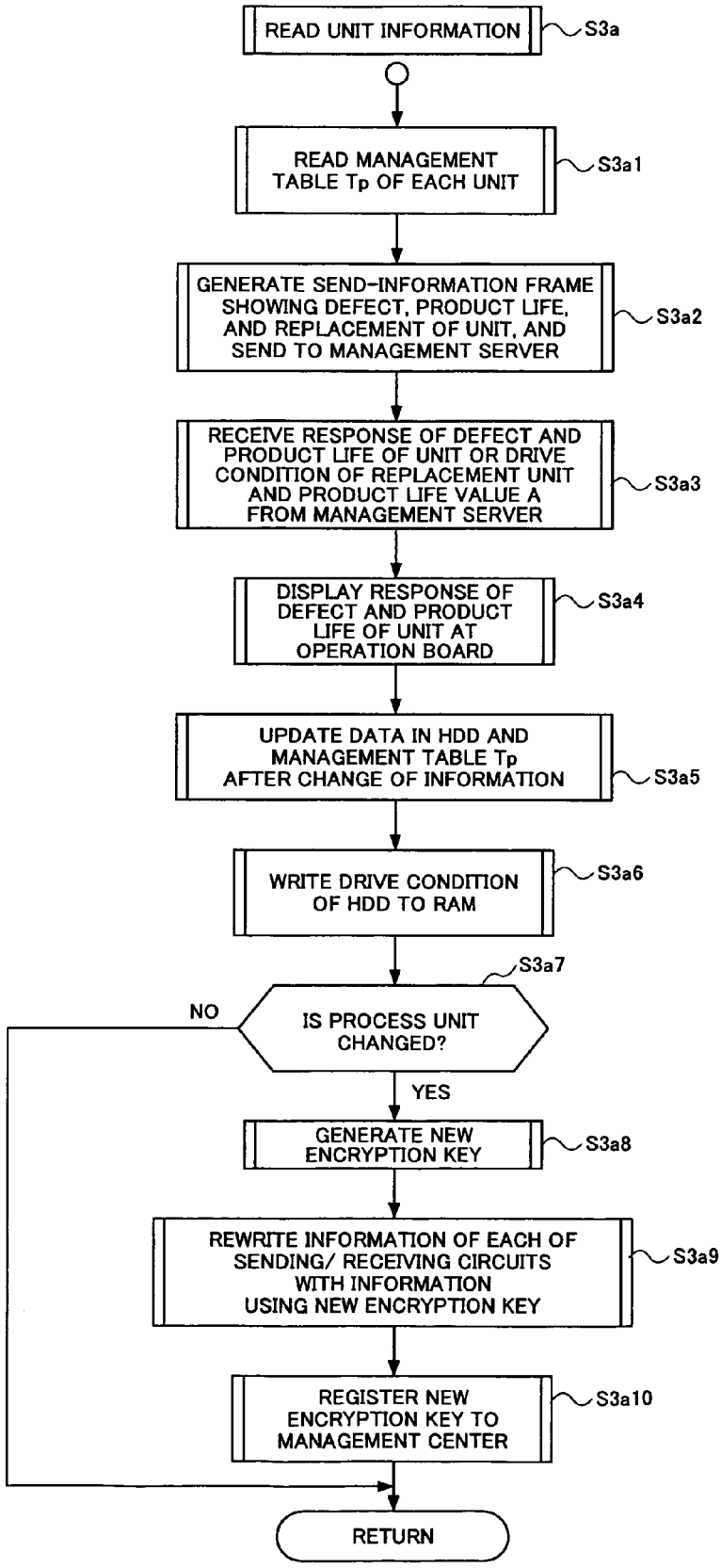
FIG. 15 is a flowchart for explaining details of step S3*a*, according to the second embodiment of the present invention.

Details of step S3*a* to read unit information conducted by the system controller 630 will be described with reference to FIG. 15. FIG. 15 is a flowchart for explaining details of step S3*a*, according to the second embodiment of the present invention. Steps S3*a*1 through S3*a*6 in FIG. 15 in the second embodiment are the saem as steps S3*a*1 through S3*a*6 shown in FIG. 7 in the first embodiment. However, in the second embodiment, when any one of the imaging process units is replaced, the system controller 630 generates code of data showing the product M obtained by multiplying the copier ID (printer ID) data M and individual ID data Pi of all imaging process units including a new imaging process unit, as a new encryption key (step S3*a*7 and step S3*a*8). The system controller 630 reads out the management information being encrypted of the imaging process units, which are not replaced, and decrypts the management information by using the process controller 131. Subsequently, the system controller 630 encrypts the management information by the new encryption key and writes the management information to the imaging process units, which are not replaced. The system controller 630 encrypts the management information of the new imaging process unit used for a replacement, and writes the management information being encrypted to the new imaging process unit to update. Then, the process controller 131 updates and registers the new encryption key to the non-volatile memory 133*b* (step S3*a*9). In addition, the process controller 630 sends the new encryption key to the management center, and the management server 500 registers the new encryption key for the copier ID (printer ID) (step S3*a*10).

Figure 13:
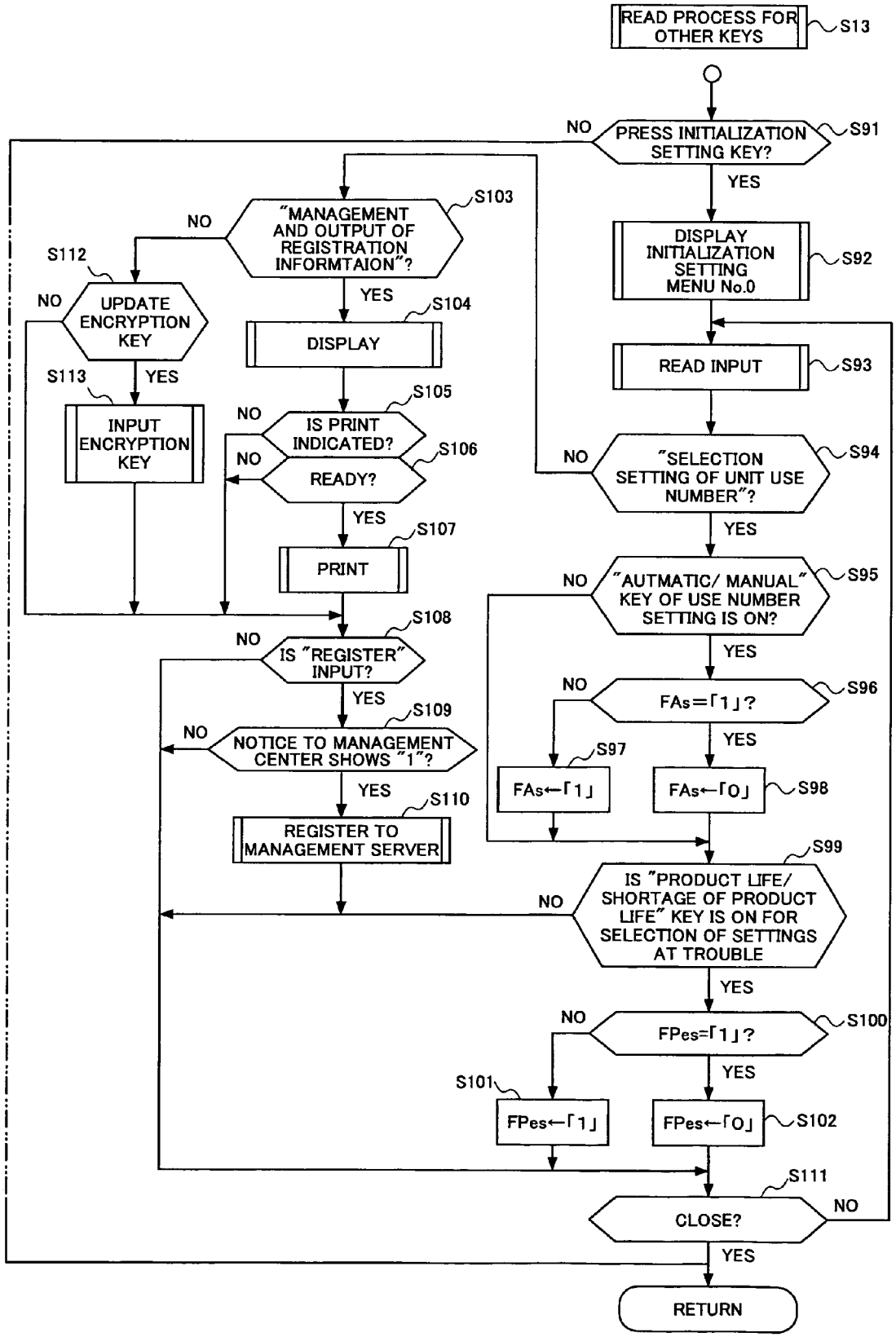
FIG. 13 is a flowchart for explaining the details of the process for reading other key in step S13 in FIG. 5, which is conducted by the system controller, according to the first embodiment of the present invention.

Since the system controller 630 automatically generates the encryption key as described above, steps S112 and S113 (to set the encryption key input by the user at the liquid crystal display) in FIG. 13 are omitted in the second embodiment. That is, in FIG. 13, a line from a branch "NO" of step S108 is directly connected to step S108. Other functions in the second embodiment are the same as the functions in the first embodiment.

According to the second embodiment of the present invention, the encryption key is changed when a part of the printer 100 (any one of the imaging process units). Even if the imaging process unit took out from the printer 100 is mounted to another printer 100, the encryption key is different in each printer 100. Accordingly, it is impossible to decrypt and read the encryption key in another printer 100. Therefore, it is possible to improve the security of the management information of the imaging process unit being took out from the printer 100.

[Third Embodiment]

Figure 16:
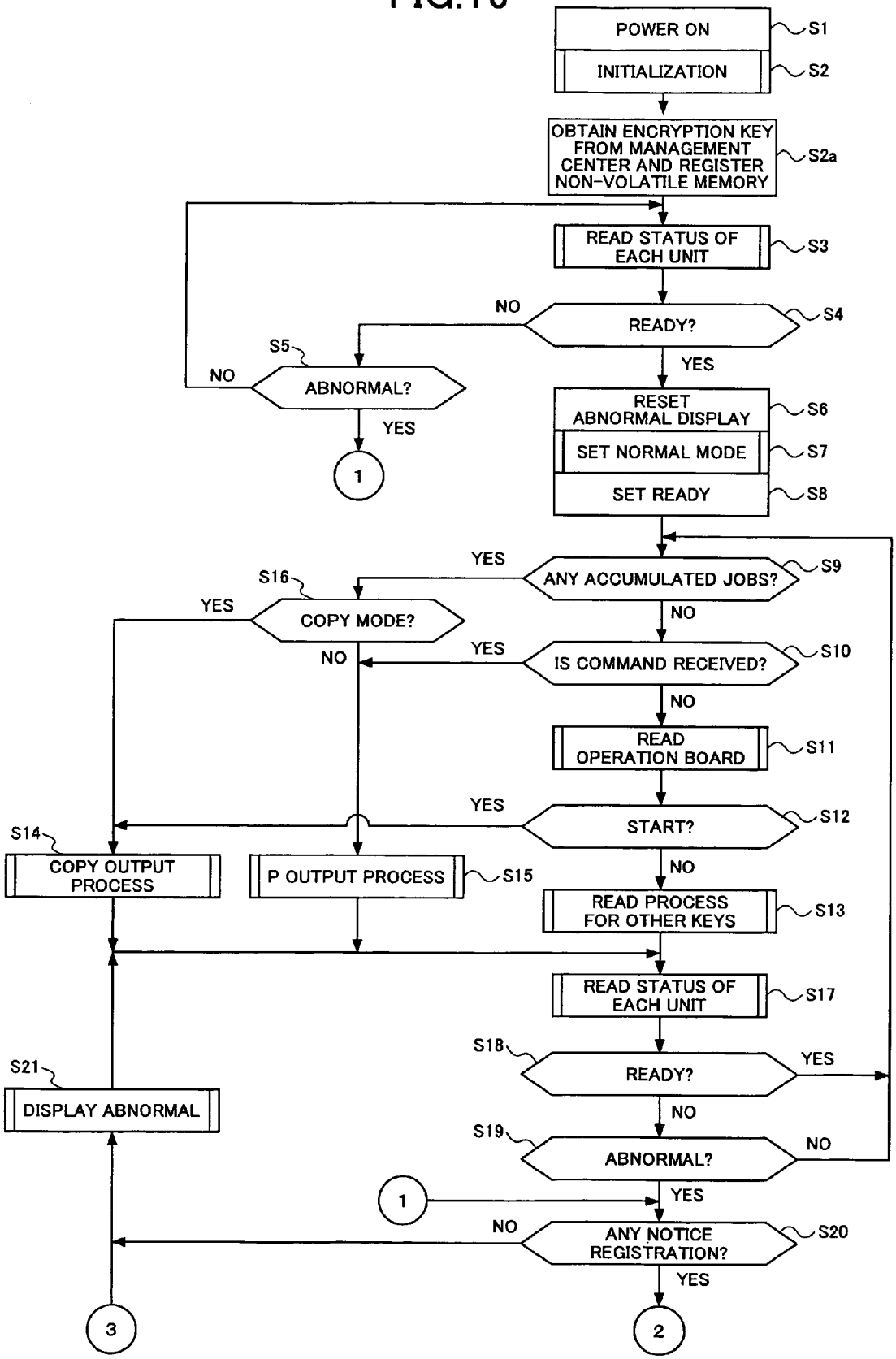
FIG. 16 is a flowchart for briefly explaining a system control of a system controller according to a third embodiment of the present invention.

In a third embodiment, similar to the second embodiment, the system controller 630 automatically generates the encryption key, and registers the encryption key to the non-volatile memory 133*b* and the management server 500 of the management center. However, as shown in FIG. 16, immediately after the printer 100 is turned on, the encryption key is obtained from the management server 500 of the management center where the encryption key is registered, and is registered to the non-volatile memory 133*b* (step S2*a*). The encrypting unit 133*c* encrypts the management information by using the encryption key and the decrypting unit 133*d* decrypts the management information by using the encryption key. Other functions in the third embodiment are the same as the functions in the second embodiment.

Each of the imaging process units having the sending/receiving circuits 81, 82, 83, . . . includes an encrypted area for storing the management information in the management memory 98.

According to the third embodiment, in a case in that it is necessary to read the use history or the like of the imaging process unit collected to recycle, or in a case in that the imaging process unit is used for another printer 100, an ID code at user side is sent to the management center, the encryption key is obtained from the management center, and the management information of the imaging process unit being collected to recycle is decrypted. Alternatively, the management information being encrypted in the imaging process unit is sent to the management center to decrypt, and the management information being decrypted is obtained. In this case, a specific user can move the imaging process unit to another printer 100 and the management information of the imaging process unit can be read. However, in a case of other users, the management information of the imaging process unit cannot be read. Moreover, for a manufacturer of the imaging process unit, contents of the imaging process unit being collected to recycle can be read by cooperating with the management center. Therefore, the manufacturer can refers to the management information as a reference for a recycle.

[Fourth Embodiment]

Figure 17:
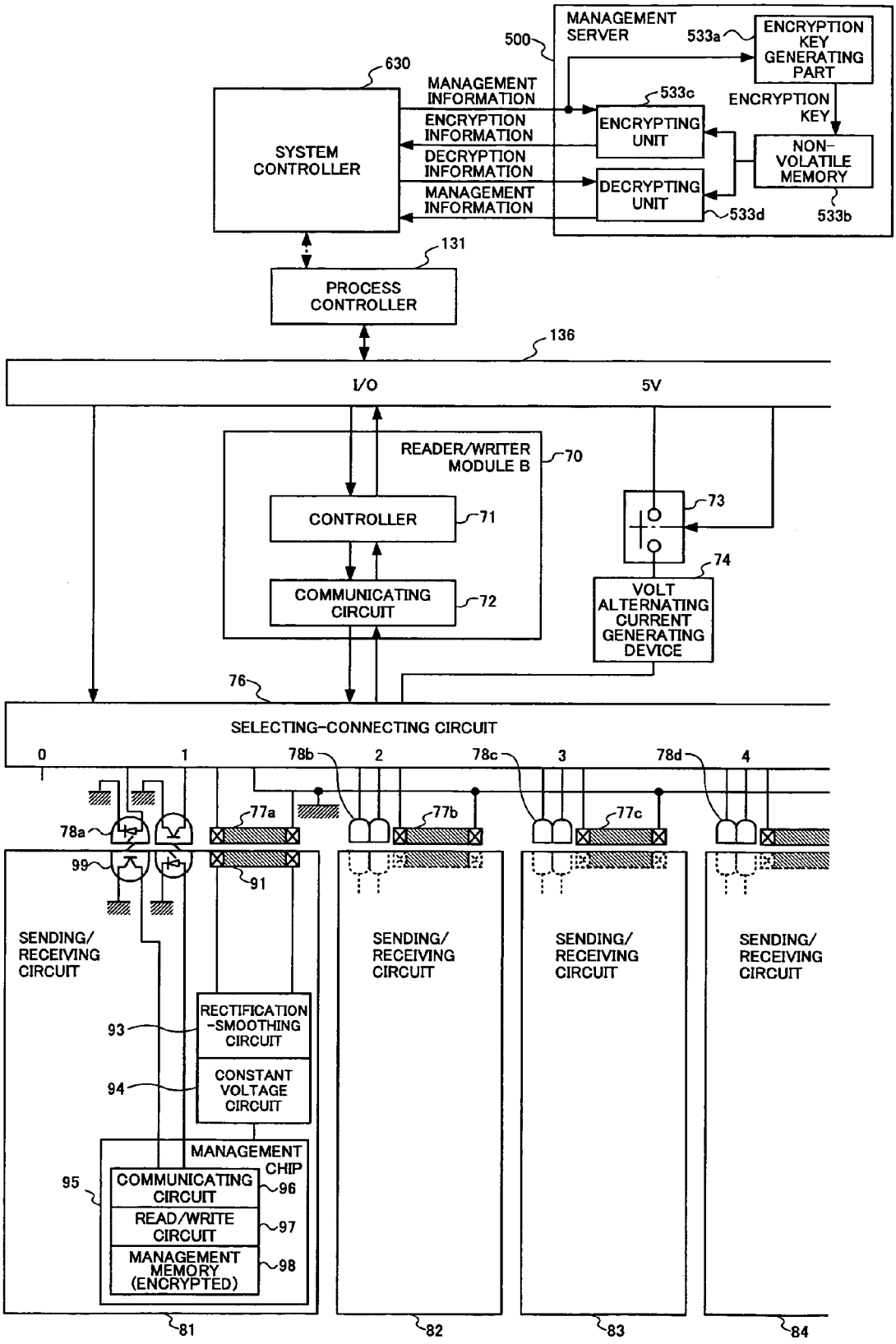
FIG. 17 is a block diagram showing a unit information transmission path from the sending/receiving circuits mounting the imaging process unit to the system controller, according to a fourth embodiment of the present invention.

In a fourth embodiment, as shown in FIG. 17, when the system controller 630 reads information from the imaging process unit, the system controller 630 sends the management information being encrypted that is read from the imaging process unit. The management server 500 decrypts the management information being encrypted and sends the management information to the system controller 630. When the system controller 630 receives the management information, the system controller 630 uses the management information to manage the printer 100. When the management information is written when a process is conducted to the imaging process unit, the system controller 630 sends the management information to the management server 500. The management server 500 encrypts the management information received from the system controller 630 of the printer 100, and sends the management information being encrypted to the system controller 630. The system controller 630 stores (write) the management information being encrypted to the imaging process unit.

Each of the imaging process units having the sending/receiving circuits 81, 82, 83, . . . includes an encrypted area for storing the management information in the management memory 98.

In the fourth embodiment, the encryption key is not input to set by using the operating board 610 and the system controller 630 does not automatically generate the encryption key. Accordingly, the encrypting unit 133*c* and the decrypting unit 133*d* as shown in FIG. 3 and FIG. 4 in the first embodiment are not configured in the printer 100. Instead, in the fourth embodiment, an encryption key generating part 533*a*, a non-volatile memory 533*b*, an encrypting unit 533*c*, and a decrypting unit 533*d* are provided in the management server 500. Step S112 and step S113 shown in FIG. 13 in the first embodiment are omitted in the fourth embodiment. Moreover, in the fourth embodiment, when the management information is read from the imaging process unit, the management server 500 is used to decrypt the management information. When the management information is written to the imaging process unit, the management server 500 is used to encrypt the management information. Other functions in the fourth embodiment are the same as the functions in the first embodiment.

In the fourth embodiment, the encryption key generating part 533*a* of the management server 500 generates the same encryption key as the encryption key generated by the system controller 630 in the second embodiment, by using the copier ID (printer ID) and an imaging process unit ID, and registers the encryption key to a non-volatile memory 533*b*. Then, the decrypting unit 533*d* of the management server 500 decrypts the management information being encrypted as encryption information from the printer 100. The encrypting unit 533*c* of the management server 500 encrypts the management information being decrypted as decryption information from the printer 100, by using the encryption key recorded in the non-volatile memory 533*b*. The management server 500 may assign a fixed encryption key for the copier ID (printer ID). In the fourth embodiment, contents of the management information cannot be read from the imaging process unit alone after the imaging process unit is took out from the printer 100.

[Fifth Embodiment]

Figure 18:
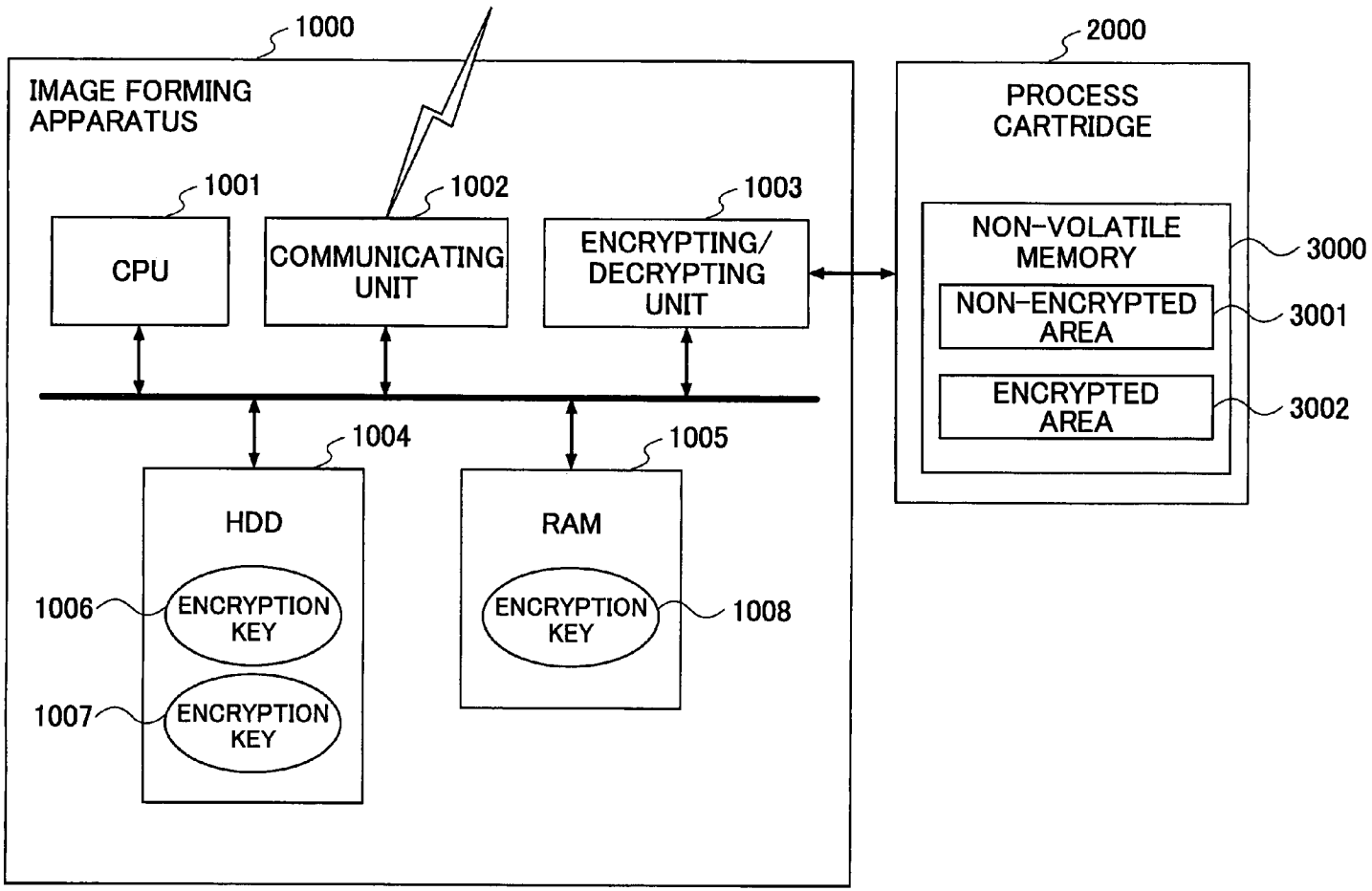
FIG. 18 is a block diagram showing configurations an image forming apparatus and a process cartridge used for the image forming apparatus according to a fifth embodiment of the present invention.

Configurations of an image forming apparatus and a process cartridge used for the image forming apparatus will be described according to a fifth embodiment of the present invention. FIG. 18 is a block diagram showing the configurations the image forming apparatus and the process cartridge used for the image forming apparatus according to the fifth embodiment of the present invention.

In the fifth embodiment, the image forming apparatus 1000 includes a controlling unit (CPU) 1001 for controlling the entire operation of the image forming apparatus 1000, a communicating unit 1002 for communicating with an external apparatus, a process cartridge 2000, an encrypting/decrypting unit 1003 for encrypting data to store in a non-volatile memory 3000 included in the process cartridge 2000 and for decrypting data stored in the non-volatile memory 3000, and an HDD 1004 and a RAM 1005 for maintaining encryption keys to decrypt data stored in the non-volatile memory 3000. The HDD 1004 stores an encryption key 1006 and the encryption key 1007. The RAM 1005 stores an encryption 1008.

In order to maintain data, the process cartridge 2000 according to the fifth embodiment of the present invention includes the non-volatile memory 3000 that does not require a power supply externally. The non-volatile memory 3000 includes a non-encrypted area 3001 for maintaining regular data that are not encrypted and an encrypted area 3002 for maintaining data that are encrypted in order to prevent from leaking or falsifying private information or a like to outside.

Figure 19:
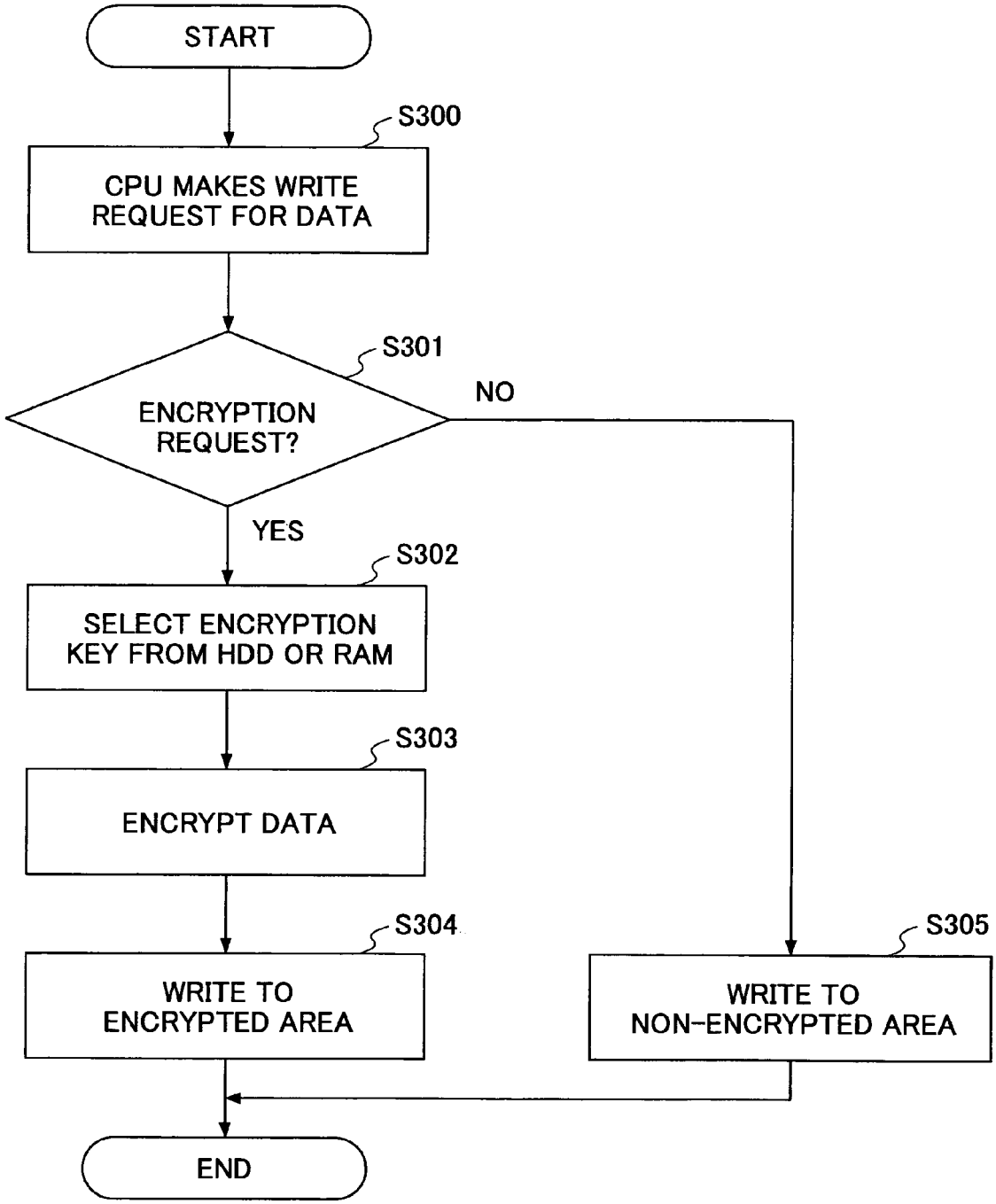
FIG. 19 is a flowchart for explaining a write operation for writing data to a non-volatile memory according to the fifth embodiment of the present invention.

Next, a write operation for writing data to the non-volatile memory 3000 by using the encrypting/decrypting unit 1003 will be described with reference to FIG. 19. FIG. 19 is a flowchart for explaining the write operation for writing data to the non-volatile memory according to the fifth embodiment of the present invention.

When a write request for writing data to the non-volatile memory 3000 is instructed by the CPU 1001 (step S300), the encrypting/decrypting unit 1003 determines whether or not data from a user of the image forming apparatus 1000 is needed to encrypt (step S301). The encrypting/decrypting unit 1003 can determine based on contents of the data, a creator of the data, and a like whether or not data from a user of the image forming apparatus 1000 is needed to encrypt. Alternatively, the user may be requested to encrypt the data from an operation part (not shown). When it is determined that the data is not needed to encrypt (NO in step S301), the encrypting/decrypting unit 1003 writes the data without encrypting the data, to the non-encrypted area 3001 (step S305). On the other hand, when it is determined that the data is needed to decrypt (YES in step S301), the encrypting/decrypting unit 1003 selects one of the encryption keys 1006, 1007, and 1008 from the HDD 1004 or the RAM 1005 of the image forming apparatus 1000 (step S302). The encrypting/decrypting unit 1003 encrypts the data based on a selected encryption key (step S303). When the data is completely encrypted, the encrypting/decrypting unit 1003 writes encrypted data to the encrypted area 3002 (step S304).

Figure 20:
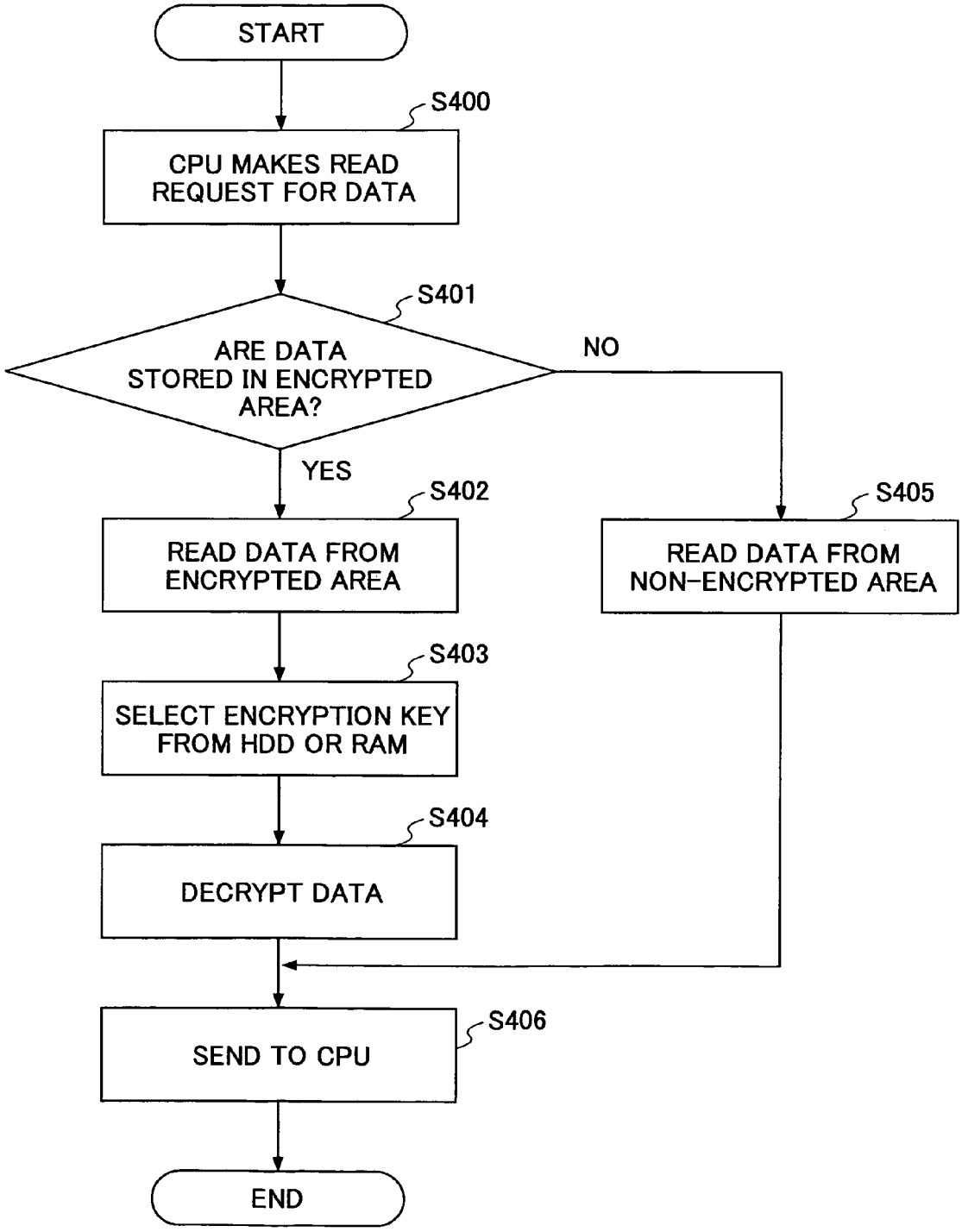
FIG. 20 is a flowchart for explaining a read operation for reading data from the non-volatile memory according to the fifth embodiment of the present invention.

Next, a read operation for reading data from the non-volatile memory 3000 by using the encrypting/decrypting unit 1003 will be described with reference to FIG. 20. FIG. 20 is a flowchart for explaining the read operation for reading data from the non-volatile memory according to the fifth embodiment of the present invention.

When a read request for reading data from the non-volatile memory 3000 is instructed by the CPU 1001 (step S400), the encrypting/decrypting unit 1003 determines whether or not the data is data being stored in the encrypted area 3002 (step S401). When it is determined that the data is stored in the non-encrypted area 3001 (NO in step S401), the encrypting/decrypting unit 1003 reads out the data from the non-encrypted area 3001 (step S405), and the data is sent to the CPU 1001 (step S406). On the other hand, when it is determined that the data is stored in the encrypted area 3002 (YES in step S401), the data is read out from the encrypted area 3002 (step S402). When the data being encrypted is read out from the encrypted area 3002, the encrypting/decrypting unit 1003 selects one encryption key corresponding to the user of the image forming apparatus 1000 from the HDD 1004 or the RAM 1005 (step S403), and decrypts the data by using the selected encrypted key (step S404). When the data is completely decrypted, the encrypting/decrypting unit 1003 sends the data being decrypted to the CPU 1001 (step S406).

The non-volatile memory 3000 of the process cartridge 2000 shown in FIG. 18 is divided into the non-encrypted area 3001 and the encrypted area 3002. Alternatively, as shown in FIG. 21, a non-encrypted area or an encrypted area is provided for each encryption key.

For example, an encrypted area 5001 is used to store data such as a total use history which cannot be changed by other agents and the user, and the data are encrypted and decrypted by an encryption key 1008. An encrypted area 5002 is used to store data concerning a recycle agent or a sales agent, and the data are encrypted and decrypted by an encryption key 1007. An encrypted area 5003 is used to store private information of the user, and the private information is encrypted and decrypted by an encryption key 1006. A non-encrypted area 5004 is used to store data which can be accessed by any user, and the data are stored without being encrypted.

Accordingly, when the encrypting/decrypting unit 1003 writes data concerning the total use history and the like to the encrypted area 5001, the encrypting/decrypting unit 1003 encrypts the data by using the encryption key 1008, and when the encrypting/decrypting unit 1003 reads the data concerning the total use history and the like from the encrypted area 5001, the encrypting/decrypting unit 1003 decrypts the data by using the encryption key 1008. Moreover, when the encrypting/decrypting unit 1003 writes the data concerning the recycle agent and the sales agent to the encrypted area 5002, the encrypting/decrypting unit 1003 encrypts the data by using the encryption key 1007, and when the encrypting/decrypting unit 1003 reads the data concerning the recycle agent and the sales agent from the encrypted area 5002, the encrypting/decrypting unit 1003 decrypts the data by using the encryption key 1007. Furthermore, the encrypting/decrypting unit 1003 writes the private information concerning the user to the encrypted area 5003, the encrypting/decrypting unit 1003 encrypts the private information by using the encryption key 1006, and when the encrypting/decrypting unit 1003 reads the private information from the encrypted area 5003, the encrypting/decrypting unit 1003 decrypts the private information by using the encryption key 1006.

As described above, data are separately maintained in store in the non-volatile memory 3000 including the non-encrypted area 3001 and the encrypted area 3002. Therefore, even if the process cartridge 2000 being used is collected by the recycle agent, it is possible to prevent the data in the non-volatile memory 3000 of the process cartridge 2000 from being leaked and falsified.

Moreover, even if encrypted data and non-encrypted data are mixed in the non-volatile memory 3000, since the encrypted data and the non-encrypted data are distinguishably stored so that the encrypted data are stored in the encrypted area 3002 and the non-encrypted data are stored in the non-encrypted area 3001, it is easily determined whether or not the data are encrypted when the data are read out from the non-volatile memory 3000.

Furthermore, since the encrypted data are classified and recorded for each encryption key, it is possible to easily specify the encryption key when the encrypted data are decrypted.

Figure 22:
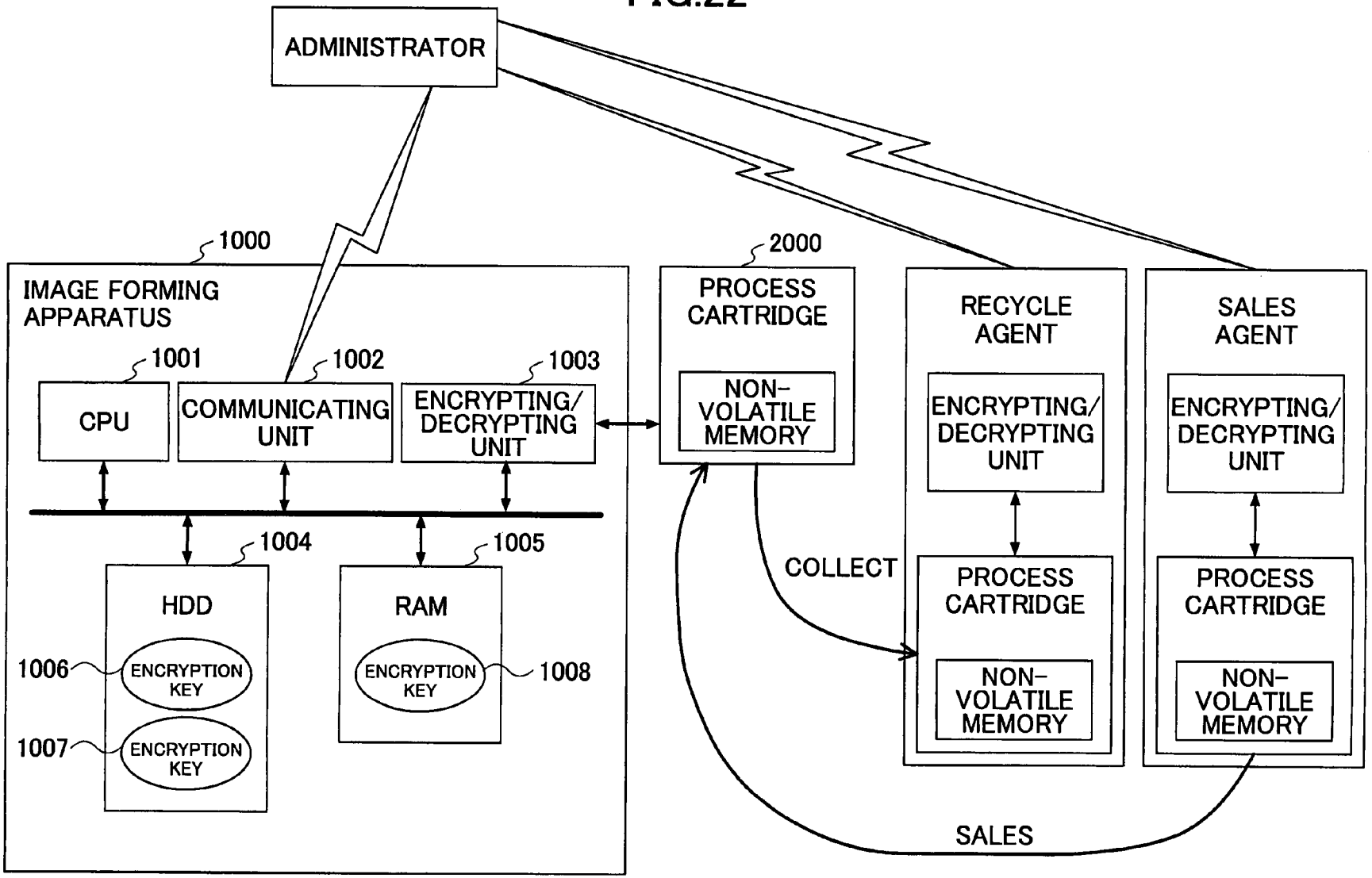
FIG. 22 is a diagram showing an operation for obtaining an encryption key from an administrator of the image forming apparatus, according to the fifth embodiment of the present invention.

Next, an operation for obtaining the encryption key 1008 from an administrator of the image forming apparatus 1000 will be described with reference to FIG. 22. FIG. 22 is a diagram showing the operation for obtaining the encryption key from the administrator of the image forming apparatus, according to the fifth embodiment of the present invention. The encryption key 1006 of the encrypted area 5003 where the private information concerning the user are stored is stored in the HDD 1004, even if the process cartridge 2000 is collected by the recycle agent, it is possible to prevent the private information from being leaked and falsified.

For example, when the recycle agent, the sales agent of the process cartridge, or the service person reads the total use history or the like of the image forming apparatus 1000, the encryption key 1008 is obtained by accessing the administrator from the communication unit 1002 through a network, and temporarily stored in the RAM 1005. In the operation processes shown in FIG. 19 and FIG. 20, the encryption key 1008 temporarily stored in the RAM 1005 are written to the encrypted area 5001 and read our from the encrypted area 5001.

Figure 23:
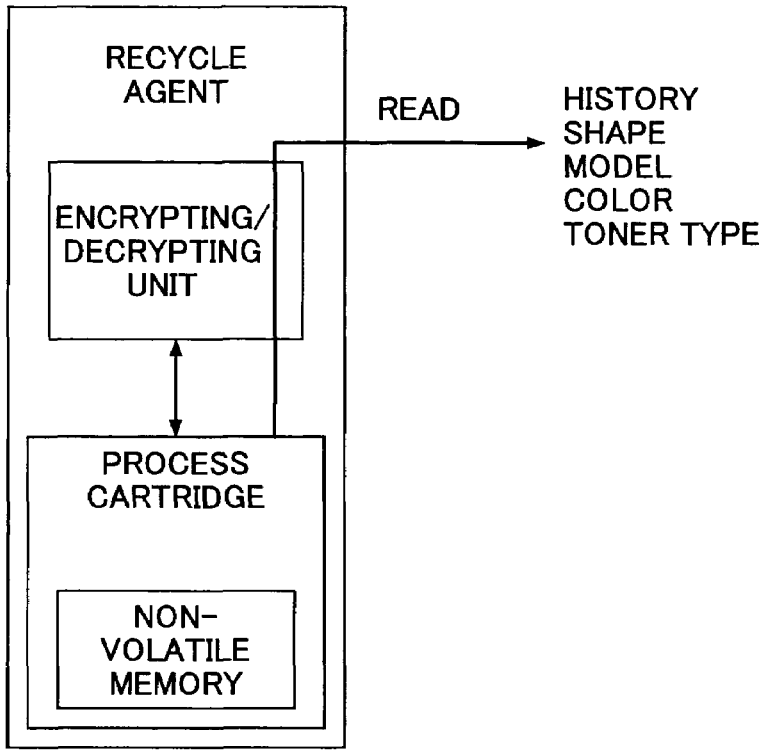
FIG. 23 is a diagram showing a data flow to read data from the non-volatile memory according to the fifth embodiment of the present invention.
Figure 24:
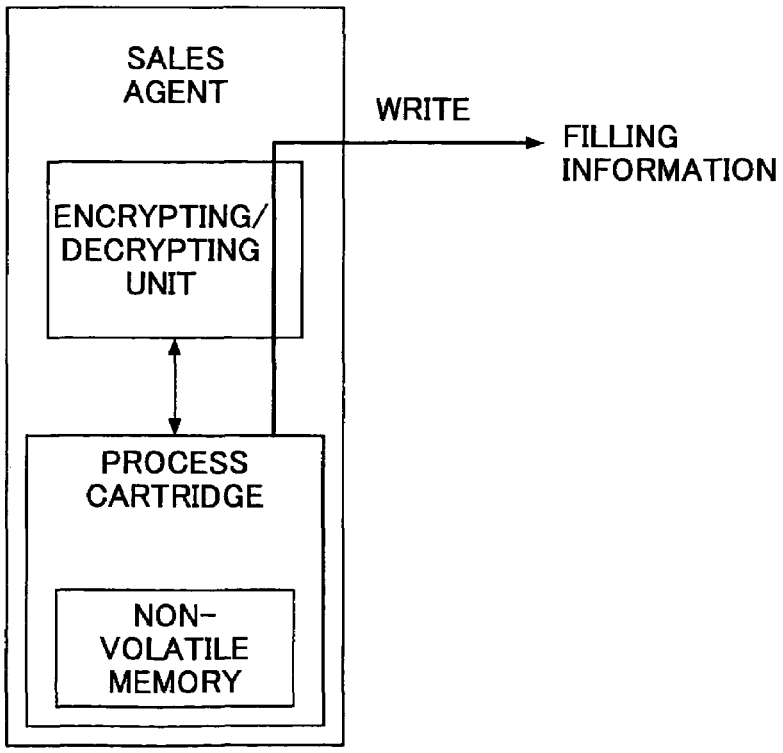
FIG. 24 is a diagram showing a data flow to write data from the non-volatile memory according to the fifth embodiment of the present invention.

The recycle agent, the sales agent of the process cartridge, the service person, and the like can write and read the total use information and the like being stored in the process cartridge being collected or the process cartridge to sell, by using the encrypting/decrypting unit connected to the network. In detail, the encryption key is obtained by accessing the encrypting/decrypting unit connected to the network, data such as a use history, a model, a shape of the process cartridge, a color of a toner, a type of the toner, and the like, which are stored in the encrypted area of the process cartridge, are decrypted by using the encryption key. Moreover, information concerning a toner which is filled can be written to data read out from the process cartridge, and can be encrypted and stored in the encrypted area again, if necessary (shown in FIG. 23 and FIG. 24).

By the above-described configuration, the recycle agent, the sales agent of the process cartridge, the service person, and the like can write and read the total use information and the like being stored in the encrypted are in the process cartridge by the encrypting/decrypting unit other than the image forming apparatus to which the process cartridge is mounted.

For example, the CPU 1001, the communicating unit 1002, the encrypting/decrypting unit 1003, the HDD 1004, and the RAM 1005 in the image forming apparatus 1000 in the fifth embodiment (FIG. 18) correspond to the CPU 605, the external device communication controller 606, the encrypting unit 133*c* and the decrypting unit 133*d*, the HDDC 650, and the RAM 603 in the printer 1000 in the first embodiment through the fourth embodiment. Moreover, the process cartridge 2000 in the fifth embodiment corresponds to the imaging process unit in the first embodiment through the fourth embodiment. Furthermore, the non-volatile memory 3000 in the fifth embodiment corresponds to the management memory 98 in the first embodiment through the fourth embodiment.

That is, the image forming apparatus 1000 according to the fifth embodiment of the present invention and the printer 100 according to the first embodiment through the fourth embodiment are not exclusively and alternatively applied to each other. Both the invention applied to the image forming apparatus 1000 and the invention applied to the printer 100 can be implemented in a single apparatus.

The present invention is not limited to the specifically disclosed embodiments, and variations and modifications may be made without departing from the scope of the present invention.

The present application is based on the Japanese Priority Applications No. 2003-425686 filed on Dec. 22, 2003, No. 2004-237608 filed on Aug. 17, 2004, and No. 2004-340702 filed on Nov. 25, 2004, the entire contents of which are hereby incorporated by reference.

What is claimed is:

1. An image forming apparatus, comprising:

said image forming apparatus configured to be detachably connected to an imaging process unit including a non-volatile memory, wherein information recorded in the non-volatile memory is partially encrypted;

an encrypting part encrypting information to write to the non-volatile memory;

a decrypting part decrypting the information being encrypted, which is read from the non-volatile memory;

an accessing part reading and writing the information being encrypted to/from the non-volatile memory; and an encryption key generating part generating the encryption key based on apparatus identification information identifying the image forming apparatus, wherein based on the encryption key generated by the encryption key generating part, the encrypting part encrypts the information and the decrypting part decrypts the information.

2. The image forming apparatus as claimed in claim 1, wherein a plurality of the imaging process units are mounted, and wherein the encryption key generating part generates the encryption key based on the process unit identification information for all of the plurality of the imaging process units.

3. The image forming apparatus as claimed in claim 1, wherein the encryption key generating part generates again the encryption key based on the process unit identification information identifying a new imaging process unit when the imaging process unit is replaced with the new imaging process unit.

4. The image forming apparatus as claimed in claim 3, wherein when the encryption key is generated again, the encrypting part encrypts attain the information being recorded in the non-volatile memory based on the encryption key that is generated again.

5. The image forming apparatus as claimed in claim 1, further comprising an encryption key sending part sending the encryption key to an information processing apparatus connected through a network.

6. The image forming apparatus as claimed in claim 5, further comprising an encryption key obtaining part obtaining the encryption key from the information processing apparatus, wherein based on the encryption key obtained from the encryption key obtaining part, the encrypting part encrypts the information and the decrypting part decrypts the information.

7. The image forming apparatus as claimed in claim 1, further comprising:

a sending part sending predetermined information to an information processing apparatus connected through a network to have the information processing apparatus encrypt the predetermined information;

a receiving part receiving information being encrypted by the information processing apparatus;

a writing part writing the information being encrypted, which is received form the information processing apparatus by the receiving part, to the non-volatile memory.

8. The image forming apparatus as claimed in claim 7, further comprising a reading part reading the information being encrypted, which is recorded in the non-volatile memory, wherein:

the sending part sends the information being encrypted, which is read by the reading part, to the information processing apparatus to have the information processing apparatus decrypt the information being encrypted; and the receiving part receives the information decrypted by the information processing apparatus.

9. The image forming apparatus as claimed in claim 1, wherein the non-volatile memory includes:

an encrypted area for recording information, which is encrypted; and a non-encrypted area for recording information, which is not encrypted.

10. The image forming apparatus as claimed in claim 9, wherein the information recorded in the encrypted area is classified for each encryption key used to encrypt the information.

11. The image forming apparatus as claimed in claim 9, further comprising a first determining part determining whether or not predetermined information is needed to be encrypted, wherein when the first determining part determines that the predetermined information is needed to be encrypted, the first determining part encrypts the predetermined information and writes the predetermined information to the encrypted area, and when the first determining part determines that the predetermined information is not needed to be encrypted, the first determining part does not encrypt the predetermined information and writes the determined information to the non-encrypted area.

12. The image forming apparatus as claimed in claim 9, further comprising a second determining part determining whether or not information to obtain from the non-volatile memory is recorded in the encrypted area, wherein when the second determining part determines that the information to obtain from the non-volatile memory is recorded in the encrypted area, the second determining part decrypts the information obtained from the non-volatile memory, and when the second determining part determines that the information to obtain from the non-volatile memory is recorded in the non-encrypted area, the second determining part does not decrypt the information obtained from the non-volatile memory.

13. A method for recording information concerning an imaging process unit including a non-volatile memory in an image forming apparatus to which the imaging process unit is detachably connected, comprising the steps of:

encrypting information to write to the non-volatile memory;

writing the information being encrypted to the non-volatile memory; and generating an encryption key based on apparatus identification information identifying the image forming apparatus, wherein information being encrypted is encrypted based on the encryption key generated.

14. The method as claimed in claim 13, further comprising the steps of:

reading the information being encrypted, which is recorded in the non-volatile memory; and decrypting the information read.

* * * * *